US007878632B2

(12) United States Patent
Kachi

(10) Patent No.: US 7,878,632 B2
(45) Date of Patent: Feb. 1, 2011

(54) LIQUID EJECTION APPARATUS AND LIQUID SUPPLY METHOD

(75) Inventor: Yasuhiko Kachi, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 615 days.

(21) Appl. No.: 11/905,270

(22) Filed: Sep. 28, 2007

(65) Prior Publication Data

US 2008/0079768 A1 Apr. 3, 2008

(30) Foreign Application Priority Data

Sep. 29, 2006 (JP) ..... 2006-269589

(51) Int. Cl.
*B41J 2/17* (2006.01)

(52) U.S. Cl. ..... 347/84; 347/20; 347/21; 347/85; 347/86; 347/87; 347/88; 347/89; 347/90; 347/91; 347/92; 347/93; 347/94

(58) Field of Classification Search ..... 347/20–40, 347/84–94
See application file for complete search history.

(56) References Cited

U.S. PATENT DOCUMENTS

| | | | | |
|---|---|---|---|---|
| 6,145,957 | A * | 11/2000 | Isobe et al. | 347/30 |
| 6,315,402 | B1 | 11/2001 | Kawase | |
| 6,394,571 | B1 * | 5/2002 | Yano et al. | 347/17 |
| 6,505,923 | B1 * | 1/2003 | Yamamoto et al. | 347/85 |
| 6,520,630 | B1 * | 2/2003 | Oda et al. | 347/85 |
| 6,712,460 | B2 * | 3/2004 | Ohashi et al. | 347/86 |
| 6,802,584 | B2 * | 10/2004 | Kageyama | 347/14 |
| 7,128,407 | B2 * | 10/2006 | Inoue et al. | 347/85 |
| 7,506,967 | B2 * | 3/2009 | Kim et al. | 347/55 |
| 7,513,592 | B2 * | 4/2009 | Miyazawa | 347/29 |
| 7,559,636 | B2 * | 7/2009 | Kitabatake et al. | 347/86 |
| 7,614,729 | B2 * | 11/2009 | Koizumi | 347/85 |
| 7,648,230 | B2 * | 1/2010 | Kachi | 347/85 |
| 2002/0130932 | A1 * | 9/2002 | Harada et al. | 347/85 |
| 2005/0285886 | A1 | 12/2005 | Okamoto | |

FOREIGN PATENT DOCUMENTS

| | | |
|---|---|---|
| JP | 2000-141687 A | 5/2000 |
| JP | 2006-35850 A | 2/2006 |

* cited by examiner

*Primary Examiner*—Ryan Lepisto
*Assistant Examiner*—Guy G Anderson
(74) *Attorney, Agent, or Firm*—Birch, Stewart, Kolasch & Birch, LLP

(57) ABSTRACT

The liquid ejection apparatus has: a head which ejects liquid; a carriage which conveys the head; a sub tank which is mounted on the carriage, accommodates the liquid to be supplied to the head, and has an elastic film deforming elastically in accordance with supply of the liquid to the head; a liquid flow channel opening and closing valve which opens and closes a first liquid flow channel between the head and the sub tank; a main tank which stores the liquid to be supplied to the sub tank; a liquid supply coupling section which couples a second liquid flow channel connected to the main tank, to the sub tank, in a state where the carriage is located in a predetermined home position; and an elastic film movement device which moves the elastic film in a direction which causes the elastic film to recover from elastic deformation to assist deformation recovery of the elastic film of the sub tank, in a state where the first liquid flow channel is closed by means of the liquid flow channel opening and closing valve and the second liquid flow channel is coupled to the sub tank by means of the liquid supply coupling section.

7 Claims, 24 Drawing Sheets

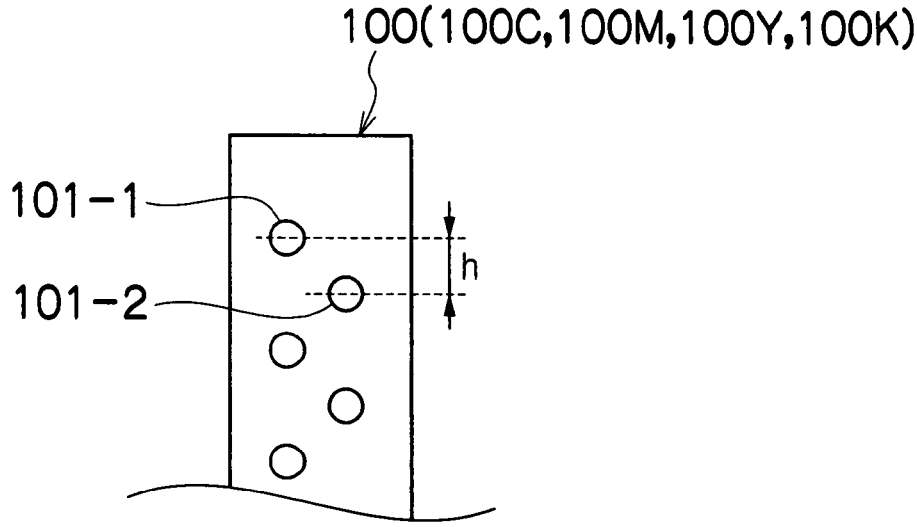
FIG.6
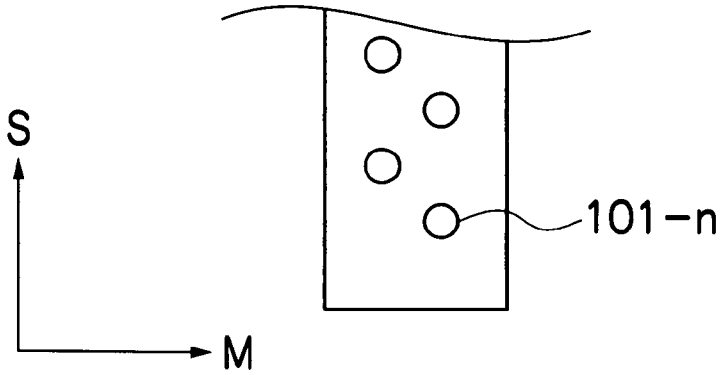
FIG.7
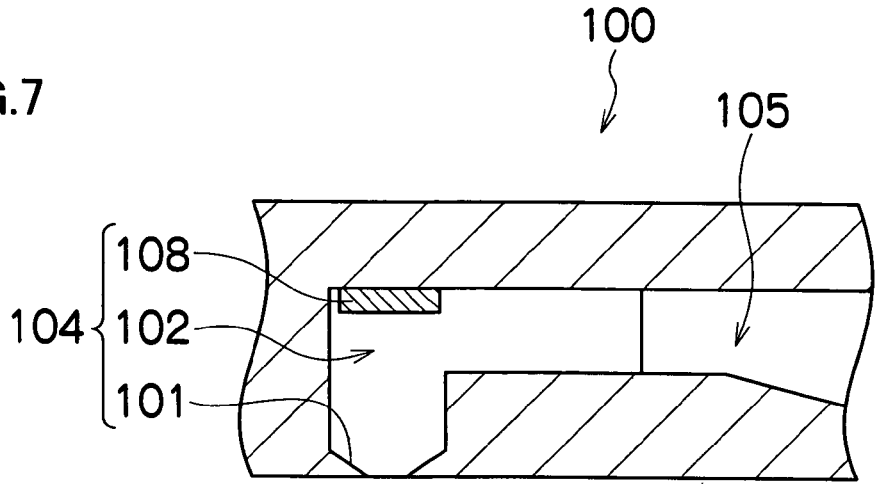

FIG.15

| PRINT MODE | INITIAL NEGATIVE PRESSURE SETTING IN SUB TANK |
|---|---|
| HIGH-SPEED MODE | $-150mmH_2O$ |
| HIGH-QUALITY MODE | $-80mmH_2O$ |

FIG.16

| AMBIENT TEMPERATURE (INK TEMPERATURE) | INITIAL NEGATIVE PRESSURE SETTING IN SUB TANK |
|---|---|
| 15°C OR ABOVE | $-150mmH_2O$ |
| LESS THAN 15°C | $-80mmH_2O$ |

LIQUID EJECTION APPARATUS AND LIQUID SUPPLY METHOD

BACKGROUND OF THE INVENTION

1. Field of the Invention

The present invention relates to a liquid ejection apparatus and a liquid supply method based on a "pit-stop" supply system in which a main tank and a sub tank are provided, and the main tank and the sub tank are connected together when it is necessary to supply ink from the main tank to the sub tank.

2. Description of the Related Art

Japanese Patent Application Publication No. 2006-35850 describes an apparatus in which, in order to achieve high-speed supply of ink during a pit-stop supply operation, a leaf spring made of a shape memory alloy is provided inside a sub tank to form a negative pressure generating device, and by passing current through the leaf spring and heating same during a pit-stop supply operation, the spring constant is raised two-fold, thereby causing the negative pressure during supply of liquid to become greater than the negative pressure at other times.

Japanese Patent Application Publication No. 2000-141687 discloses an apparatus comprising, provided with an ink supply channel, a hermetically sealed ink bag, a case which covers and hermetically seals the ink bag, a pressure adjusting device which is capable of adjusting the pressure of the air between the ink bag and the case, a first opening and closing valve provided at the ink inlet of the ink bag, and a second opening and closing valve provided at the ink outlet. Ink is supplied to the ink bag and the negative pressure thereof is adjusted by closing the second opening and closing valve, opening the first opening and closing valve, and adjusting the pressure between the ink bag and the case. Furthermore, after supplying ink to the ink bag, the first opening and closing valve is closed, the pressure between the ink bag and the case is maintained, and the second opening and closing valve is opened.

If using a shape memory alloy as described in Japanese Patent Application Publication No. 2006-35850, after supplying ink by heating the alloy, a long time is required until the temperature of the shape memory alloy falls and the pressure inside the sub tank returns to a suitable negative pressure for printing. If liquid is ejected from the liquid ejection head immediately after the supply of ink, then since the pressure in the sub tank is greater than the suitable negative pressure for printing, immediately after the supply of ink, the droplets of liquid ejected from the liquid ejection head become smaller in size. Furthermore, if using a shape memory alloy, in general, it is only possible to raise the spring constant by approximately two times. In other words, it is only possible to increase the ink supply speed by approximately two times.

In a system which utilizes the air pressure between an ink bag and a case in order to supply ink, as described in Japanese Patent Application Publication No. 2000-141687, since the air is compressible, then it is not possible to supply ink at high speed. Furthermore, if ink is supplied by adjusting the internal pressure of the sub tank to a pressure in the region of the negative pressure specified for printing, then the ink supply speed becomes slower.

SUMMARY OF THE INVENTION

The present invention has been contrived in view of these circumstances, an object thereof being to provide a liquid ejection apparatus and a liquid supply method whereby the pressure inside a sub tank can be set swiftly to a prescribed initial pressure, while being able to supply liquid to the sub tank at high speed.

In order to attain the aforementioned object, the present invention is directed to a liquid ejection apparatus, comprising: a head which ejects liquid; a carriage which conveys the head; a sub tank which is mounted on the carriage, accommodates the liquid to be supplied to the head, and has an elastic film deforming elastically in accordance with supply of the liquid to the head; a liquid flow channel opening and closing valve which opens and closes a first liquid flow channel between the head and the sub tank; a main tank which stores the liquid to be supplied to the sub tank; a liquid supply coupling section which couples a second liquid flow channel connected to the main tank, to the sub tank, in a state where the carriage is located in a predetermined home position; and an elastic film movement device which moves the elastic film in a direction which causes the elastic film to recover from elastic deformation to assist deformation recovery of the elastic film of the sub tank, in a state where the first liquid flow channel is closed by means of the liquid flow channel opening and closing valve and the second liquid flow channel is coupled to the sub tank by means of the liquid supply coupling section.

In this aspect of the present invention, when the elastic film is made to recover from elastic deformation in accordance with the decrease in the liquid in the sub tank, this recovery is not only dependent on the elastic force of the elastic film, but rather the elastic film is made forcibly to recover from elastic deformation by moving the elastic film in a direction which causes it to recover from elastic deformation. Therefore, it is possible to supply liquid to the sub tank at high speed, and furthermore, it is also possible swiftly to restore the pressure (negative pressure) in the sub tank to a desired initial value (initial negative pressure).

Furthermore, since the elastic film is made forcibly to recover from elastic deformation by moving the elastic film in a direction such that it recovers from elastic deformation, then it is possible to set the coefficient of elasticity of the elastic film to a low value. Supposing that the coefficient of elasticity of the elastic film of the sub tank is set to a high value in order to raise the speed of liquid supply to the sub tank, then there would be a large variation in the negative pressure in the sub tank as a result of reduction in the liquid volume in the sub tank as liquid is ejected from the head. In this aspect of the present invention, it is possible to eject liquid stably over a long period of time, by means of one "pit-stop" supply operation.

Furthermore, since the elastic film is made forcibly to recover from elastic deformation by means of the elastic film movement device, then it is possible to set any desired differential (namely, the "hydraulic head differential" or "liquid head differential") between the height of the liquid surface in the main tank and the height of the nozzle surface of the head. This affords great freedom in the arrangement of the main tank.

Preferably, the elastic film movement device sets a pressure in the sub tank according to at least one of ambient temperature, temperature of the liquid, viscosity of the liquid, and an operation mode selected from a plurality of modes having respectively different consumption rates of the liquid.

Preferably, the liquid flow channel opening and closing valve opens and closes the first liquid flow channel between the head and the sub tank by using a movement operation of the carriage; and the elastic film movement device moves the elastic film to assist the deformation recovery of the elastic film by using the movement operation of the carriage.

According to this aspect of the present invention, it is possible to simplify the composition in comparison with a case where separate actuators are provided as a device for driving the liquid flow channel opening and closing valve and as a device for moving the elastic film.

Preferably, the liquid ejection apparatus further comprises a deformation amount determination device which determines an amount of deformation of the elastic film of the sub tank, wherein the elastic film movement device moves the elastic film of the sub tank according to the amount of deformation of the elastic film determined by the deformation amount determination device.

Examples of the deformation amount determination device include: a strain gauge disposed on the surface of the elastic film, an optical sensor which determines the amount of deformation of the elastic film according to the movement of a link member (arm) provided between the elastic film movement device and the elastic film, and the like.

According to this aspect of the invention, the amount of deformation of the elastic film of the sub tank is determined, and the elastic film of the sub tank is moved on the basis of the determined amount of deformation. Therefore, it is possible to restore the pressure in the sub tank quickly and reliably.

If a strain gauge or optical sensor is used as the deformation amount determination device, it is possible accurately to determine the amount of elastic deformation of the elastic film, and hence the pressure in the sub tank can be restored quickly to an appropriate value. Furthermore, if an optical sensor is used, then it is possible to determine the amount of deformation of the elastic film, readily.

Preferably, the liquid ejection apparatus further comprises a home position determination device which determines whether the carriage is situated in a particular home position to outputs a determination signal, wherein the elastic film movement device moves the elastic film of the sub tank according to the determination signal outputted from the home position determination device, and an amount of movement of the carriage with reference to the home position or an amount of rotation of a motor which drives the carriage.

According to this aspect of the invention, since the elastic film is moved on the basis of the position of the carriage, then the supply of liquid to the sub tank and the initial setting of the pressure in the sub tank can be carried out readily, without needing to determine the amount of deformation by means of a deformation amount determination device.

Preferably, a coupling home position where the carriage is withdrawn from a liquid ejection region and the second liquid flow channel is coupled with the sub tank by means of the liquid supply coupling section, and a return home position which is nearer to the liquid ejection region than the coupling home position are provided for the carriage; and when an amount of the liquid in the sub tank is smaller than a prescribed minimum value, then the carriage is moved to the coupling home position and waits for the elastic film to be recovered from elastic deformation by means of the elastic film movement device, whereas when the amount of liquid in the sub tank is equal to or greater than the prescribed minimum value, then the carriage returns to the return home position to perform a reciprocal movement.

In order to attain the aforementioned object, the present invention is also directed to a liquid supply method for a liquid ejection apparatus having a head which ejects liquid, a carriage which conveys the head, a sub tank which is mounted on the carriage and accommodates the liquid to be supplied to the head and which has an elastic film deforming elastically in accordance with supply of the liquid to the head, and a main tank which stores the liquid to be supplied to the sub tank, the liquid supply method comprising the steps of: closing a valve provided in a first liquid flow channel between the head and the sub tank; coupling a second liquid flow channel connected to the main tank, to the sub tank, in a state where the carriage is located in a predetermined home position; moving the elastic film in a direction which causes the elastic film to recover from elastic deformation to assist deformation recovery of the elastic film of the sub tank, in a state where the valve provided in the first liquid flow channel is closed and the second liquid flow channel is coupled to the sub tank; separating the second liquid flow channel connected to the main tank, from the sub tank; and opening the valve provided in the first liquid flow channel between the head and the sub tank.

According to the present invention, it is possible to set the pressure in the sub tank swiftly to a prescribed initial negative pressure, without using a shape memory alloy, while also being able to supply liquid to the sub tank at high speed.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIGS. 2A and 2B are plan diagrams showing the principal part of one example of the inkjet recording apparatus relating to the first embodiment, in which FIG. 2A is a plan diagram showing a state where an elastic film has undergone elastic deformation, and FIG. 2B is a plan diagram showing a state where the elastic film has recovered from elastic deformation;

FIG. 6 is a diagram showing one example of a nozzle arrangement in a head;

FIG. 7 is a cross-sectional diagram showing one example of the head;

FIG. 15 is an illustrative diagram showing an example of initial negative pressure settings for a sub tank in accordance with the print mode;

FIG. 16 is an illustrative diagram of an example of initial negative pressure settings for a sub tank corresponding to the ambient temperature or the ink temperature;

FIGS. 17A and 17B are side view diagrams showing the principal part of one example of an inkjet recording apparatus relating to a second embodiment of the invention, in which FIG. 17A is a side view diagram showing a state where an elastic film has undergone elastic deformation, and FIG. 17B is a side view diagram showing a state where the elastic film has recovered from elastic deformation;

FIGS. 18A and 18B are plan diagrams showing the principal part of one example of the inkjet recording apparatus relating to the second embodiment, in which FIG. 18A is a plan diagram showing a state where an elastic film has undergone elastic deformation, and FIG. 18B is a plan diagram showing a state where the elastic film has recovered from elastic deformation;

DETAILED DESCRIPTION OF THE PREFERRED EMBODIMENTS

First Embodiment

Figure 1:
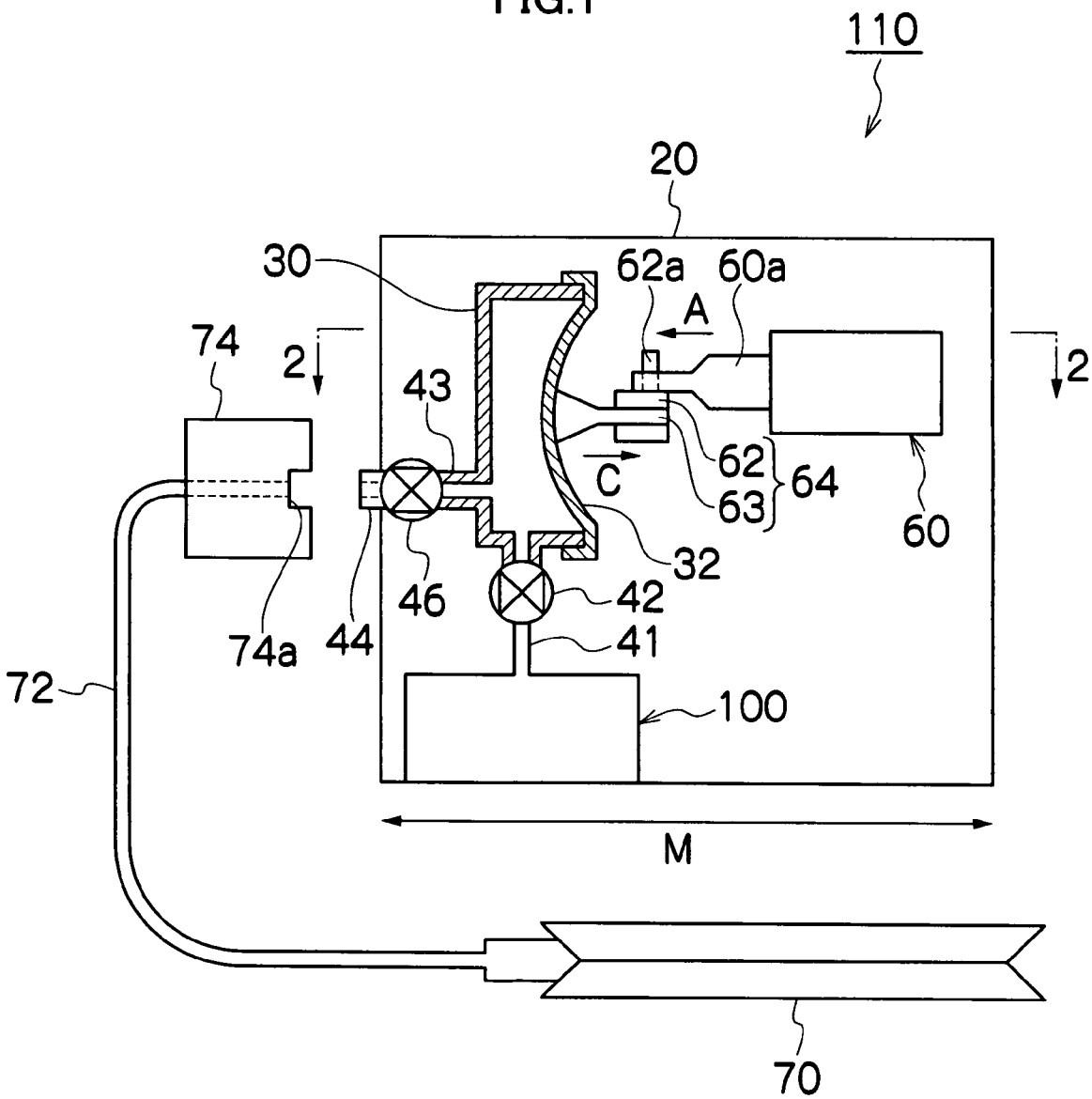
FIG. 1 is a side view showing the principal part of one example of an inkjet recording apparatus relating to a first embodiment of the present invention.

FIG. 1 is a side view showing the principal part of an inkjet recording apparatus 110 which forms one example of a first embodiment of the present invention. FIG. 1 shows the aspect of a carriage 20 which conveys a liquid ejection head 100 (hereinafter, called "head"), as viewed from the side. In FIG. 1, in order to aid understanding of the present embodiment, the inside portion of the carriage 20 is depicted in an exposed state.

The head 100 is mounted on a carriage 20, and is conveyed by the carriage 20 in a main scanning direction which is indicated by the arrow M in FIG. 1 (a direction which is perpendicular to the conveyance direction of a recording medium), during which the head 100 ejects ink onto a prescribed recording medium. An example of the head 100 is described in detail below.

As well as the head 100, a sub tank 30 which supplies ink to the head 100 is also mounted on the carriage 20. In FIG. 1, in order to aid understanding of the present embodiment, the sub tank 30 is depicted in a vertical cross-sectional view.

A liquid flow channel 41 (hereinafter, called "head liquid supply flow channel") for supplying ink to the head 100 from the sub tank 30 is provided between the head 100 and the sub tank 30. A valve 42 (hereinafter, called "head opening and closing valve") is provided in the head liquid supply flow channel 41. The head liquid supply flow channel 41 is opened and closed by opening and closing the head opening and closing valve 42, thereby switching between supplying ink from the sub tank 30 to the head 100, and halting this supply of ink.

The sub tank 30 accommodates ink to be supplied to the head 100. One portion of the wall surfaces of the sub tank 30 is constituted by a single elastic film 32 which deforms elastically in accordance with the supply of liquid to the head 100. In other words, the elastic film 32 deforms elastically as the amount of ink in the sub tank 30 becomes smaller.

The material of the elastic film 32 is, for example, a resin film. The thickness of the elastic film 32 is, for example, 20 to 30 μm.

A linear movement motor 60 causes the elastic film 32 to move, via an arm 64, in a direction which causes the elastic film 32 of the sub tank 30 to recover from elastic deformation (the direction indicated by reference symbol C in FIG. 1), thereby assisting the recovery from deformation of the elastic film 32. More specifically, as shown by the plan diagram in FIG. 2A, which is viewed along line 2-2 in FIG. 1 (showing a horizontal cross-sectional view of the sub tank 30), by driving the linear movement motor 60, a linear movement shaft 60*a* of the motor 60 moves linearly in the direction indicated by arrow A, a projection-shaped engaging section 62*a* provided on one end of a rotating section 62 of the arm 64 is pushed by a recess-shaped engaging section 60*b* provided in the linear movement shaft 60*a*, thereby causing the rotating section 62 of the arm 64 to rotate in a clockwise direction as indicated by arrow B about a rotational axle 62*b*, and by means of a joint 62*c* provided on the other end of the rotating section 62 of the arm 64, a linear movement section 63 of the arm 64 is caused to move in the direction indicated by arrow C, in other words, in a direction which causes the elastic film 32 which is coupled to the end of the linear movement section 63 of the arm 64 (namely, to the opposite end from the joint 62*c*) to recover from elastic deformation.

The main tank 70 shown in FIG. 1 is an ink source which stores ink to be supplied to the sub tank 30 mounted on the carriage 20. The main tank 70 is connected to a liquid flow channel 72 (hereinafter, called "sub tank liquid supply flow channel") for supplying ink from the main tank 70 to the sub tank 30.

The ink supply coupling section 74 couples the sub tank liquid supply flow channel 72 to the sub tank 30, when the carriage 20 is located in a prescribed home position where it is withdrawn from the liquid ejection region in the main scanning direction M. More specifically, by means of the recess section 74*a* of the ink supply coupling section 74 fitting together with the projection-shaped end section 44 (hereinafter, called "ink supply receiving coupling section") of the liquid flow channel 43 (hereinafter, called "sub tank liquid supply receiving flow channel"), which is connected to the sub tank 30, the opening of the ink supply coupling section 74 becomes coupled together with the opening of the ink supply receiving coupling section 44, and therefore the sub tank liquid supply flow channel 72 is coupled to the sub tank 30.

A valve 46 (hereinafter, called "sub tank opening and closing valve") is provided in the sub tank supply receiving flow channel 43 between the ink supply receiving coupling section 44 and the sub tank 30 in the carriage 20 (this flow channel corresponds to a portion of the sub tank liquid supply flow channel 72 leading from the main tank 70 to the sub tank 30). By opening and closing the sub tank opening and closing valve 46, the sub tank liquid supply receiving flow channel 43 opens and closes (in other words, the sub tank liquid supply flow channel 72 opens and closes), thereby switching between providing a supply of ink from the main tank 70 to the sub tank 30, and halting this supply of ink.

Figure 3:
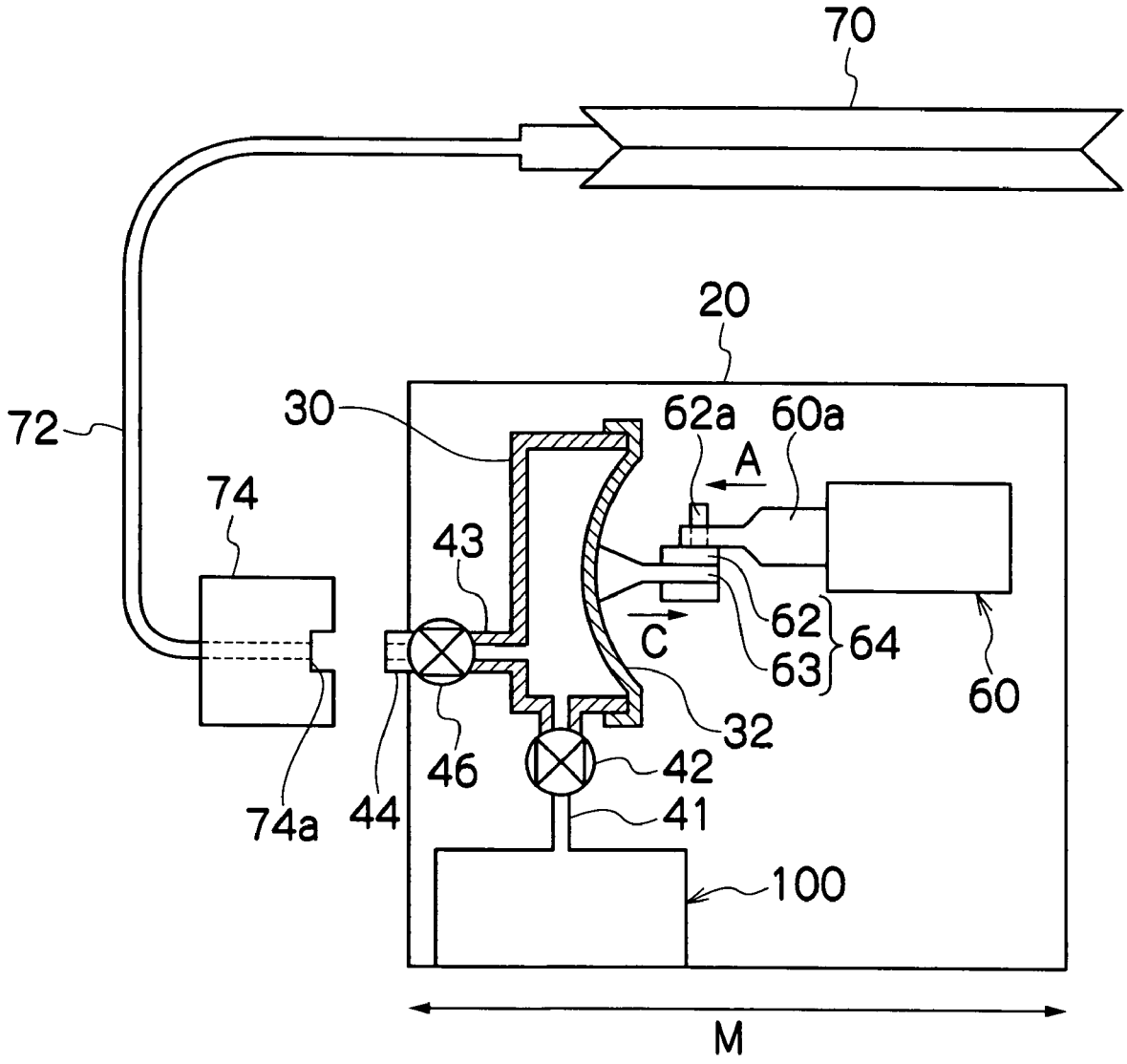
FIG. 3 is a side view showing the principal part of a further example of the inkjet recording apparatus relating to the first embodiment.

Although FIG. 1 depicts an example where the main tank 70 is disposed to the lower side of the liquid ejection surface of the head 100 in terms of the vertical direction, the arrangement of the main tank 70 is not limited to this case. As shown in FIG. 3, it is also possible to dispose the main tank 70 to the upper side of the liquid ejection surface of the head 100 (i.e. above the liquid ejection surface of the head 100), in terms of the vertical direction.

Furthermore, in the present example, the linear movement motor 60 which forms an elastic film movement device for moving the elastic film 30 is mounted on the carriage 20 together with the sub tank 30 and the arm 64; however, the composition is not limited in particular to a case of this kind. The linear movement motor 60 may also be mounted on the main body side of the inkjet recording apparatus 110, rather than on the carriage 20, being composed so as to act on the arm 64 when the carriage 20 is situated in the prescribed home position.

Figure 4:
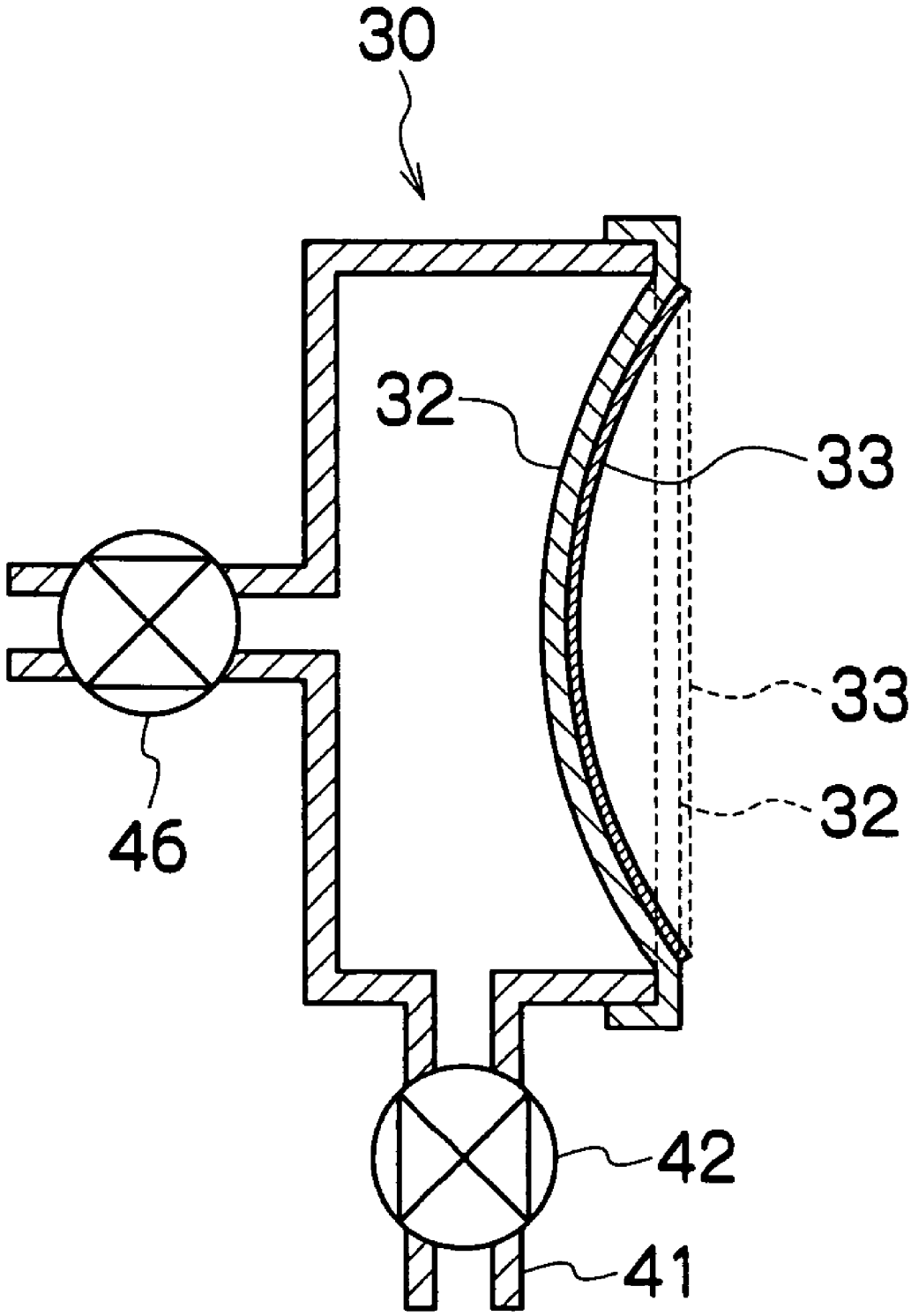
FIG. 4 is a cross-sectional diagram of a sub tank showing an example in which a strain gauge is used as an elastic deformation amount determination unit.

FIG. 4 is a diagram showing an enlarged view of one example of the sub tank 30 and the peripheral region thereof.

In the present embodiment, a strain gauge 33 is attached to the elastic film 32, to serve as an elastic deformation amount determination unit (330 in FIG. 13) which determines the amount of deformation of the elastic film 32 of the sub tank 30. For the strain gauge 33, it is possible to use a commonly known element, which determines the strain (deformation) generated in an elastic film 32, as a change in the resistance of the element.

The elastic deformation amount determination unit in the present invention is not limited in particular to such a strain gauge.

Figure 5A:
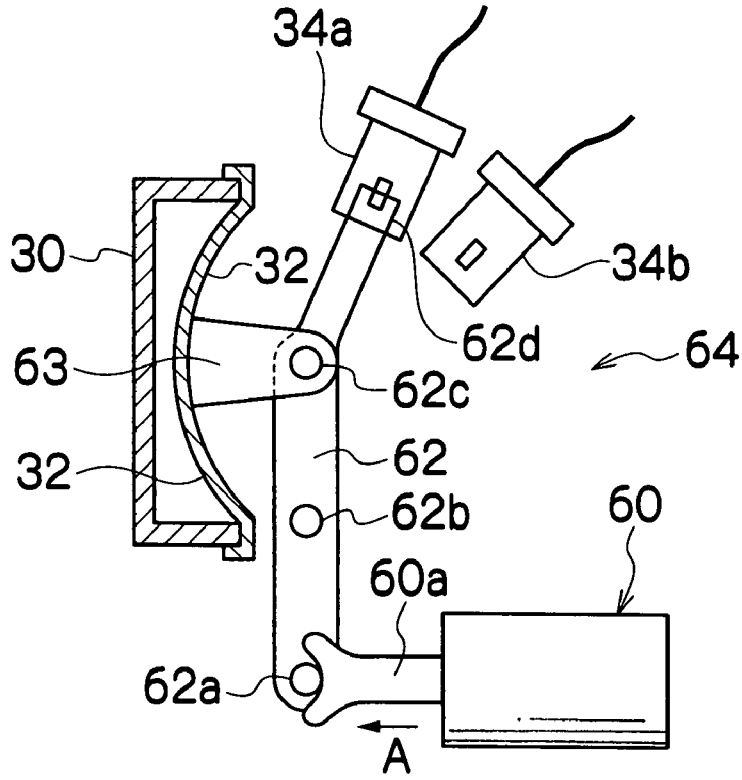
FIG. 5A is a plan diagram showing a state where an elastic film has undergone elastic deformation in an example where optical sensors are used as an elastic deformation amount determination unit.
Figure 5B:
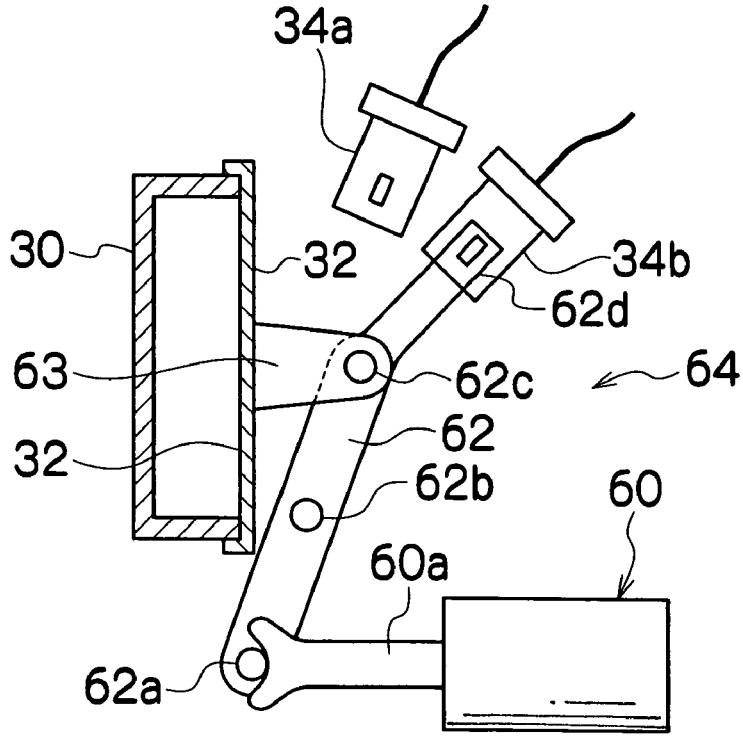
FIG. 5B is a plan diagram showing a state where the elastic film has recovered from elastic deformation in the example.

FIGS. 5A and 5B are diagrams showing an enlarged view of a further example of the sub tank 30 and the peripheral region thereof, in a case where the amount of deformation of the elastic film 32 is determined by using an optical sensor.

In the present example, the rotating section 62 of the arm 64 bends in the vicinity of the joint 62*c* and is extended further, and this extended end section 62*d* of the rotating section 62 is determined by means of an optical sensor (a first optical sensor 34*a* and a second optical sensor 34*b*). More specifically, as shown in FIG. 5A, when the volume of the sub tank 30 has become a minimum, then the end section 62*d* of the rotating section 62 of the arm 64 is determined by the first optical sensor 34*a*, and a signal indicating that the amount of ink inside the sub tank 30 has become a minimum (minimum ink position signal) is output by the first optical sensor 34*a*. On the other hand, as shown in FIG. 5B, when the volume of the sub tank 30 has become a maximum, then the end section 62*d* of the rotating section 62 of the arm 64 is determined by the second optical sensor 34*b*, and a signal indicating that the amount of ink inside the sub tank 30 has become a maximum (maximum ink position signal) is output by the second optical sensor 34*b*.

Example of Composition of Head

FIG. 6 is a diagram showing an example of the nozzle arrangement in the head 100 shown in FIG. 1.

The head 100 has n nozzles 101 (101-1 to 101-*n*) and these n nozzles are arranged in a staggered configuration in two rows. By arranging the nozzles 101 in a staggered configuration in this fashion, it is possible to reduce the pitch between nozzles in the effective nozzle row obtained by projecting the nozzles to an alignment in the sub-scanning direction S (the conveyance direction of the recording medium) (e.g., to reduce the distance h in the sub-scanning direction between the nozzle 101-1 and the nozzle 101-2 in FIG. 6).

FIG. 7 is a cross-sectional diagram showing the principal part of the head 100 in FIG. 1. In FIG. 7, for the sake of convenience, the liquid droplet ejection element 104 relating to one nozzle (one channel) only is depicted, but in actual fact, the head 100 is constituted by means of a plurality of droplet ejection elements 104.

Each nozzle 101 is connected to a pressure liquid chamber 102 which accommodates ink, and furthermore, the pressure liquid chambers 102 in the head are connected to a common flow channel 105 which supplies ink to a plurality of pressure liquid chambers 102. The common flow channel 105 is connected to sub tanks 30 which correspond to the respective colors (30C, 30M, 30Y and 30K in FIG. 10), and the ink for ejection is supplied to each pressure liquid chamber 102 in each head, from the sub tank 30, via the common flow channel 105.

Furthermore, as shown in FIG. 7, a pressurization element (here, a heater) 108 is provided inside each pressure liquid chamber 102, as a device which pressurizes the ink inside the pressure liquid chamber 102. By driving the pressurization element 108, the ink inside the pressure liquid chamber 102 is made to assume a boiling state, thereby generating a bubble, and ink is ejected from the nozzle 101 due to the pressure of the generated bubble. In other words, the head 100 shown in the present embodiment employs, for example, a thermal method which uses the pressure of a gas bubble generated in the pressure liquid chamber due to the heating energy of a heater, as a force for ejecting ink.

Positional Arrangement of Carriage

Figure 8:
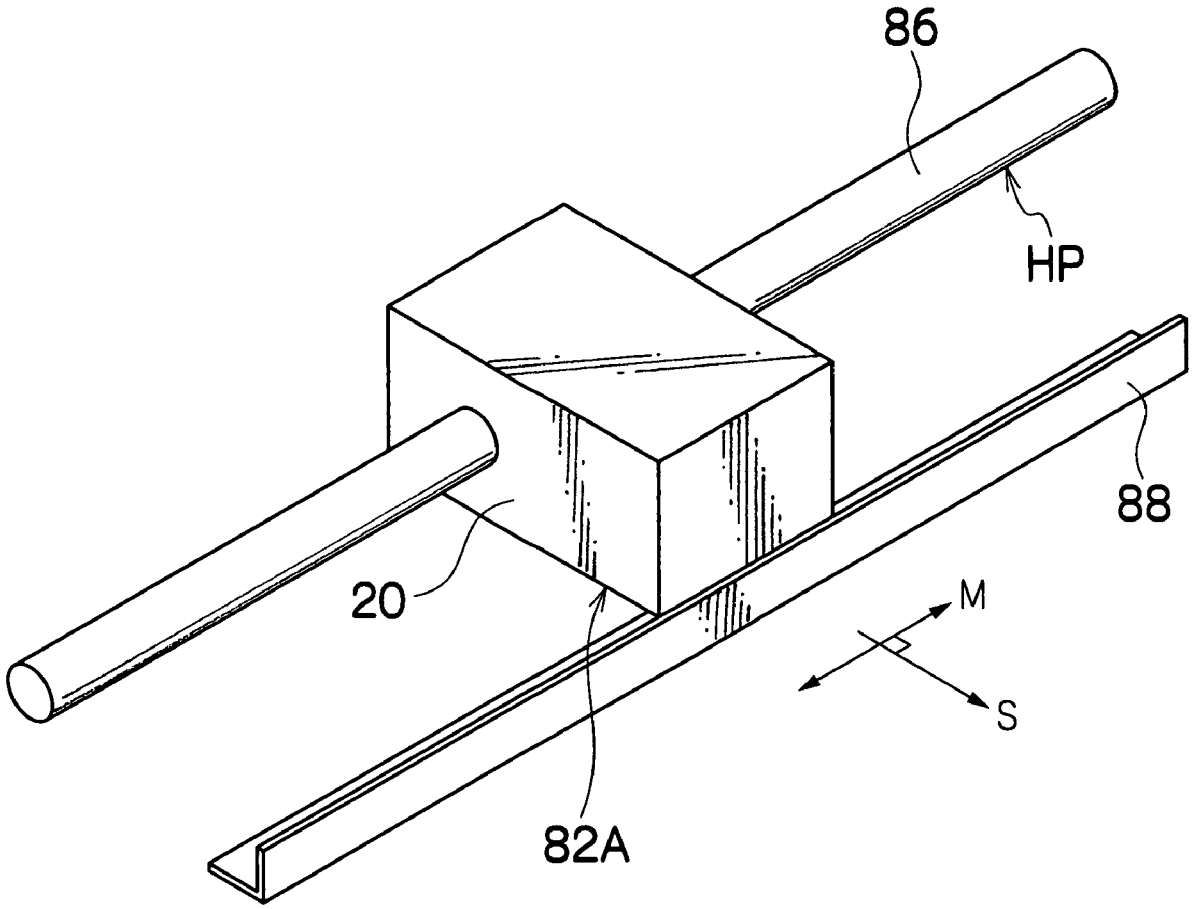
FIG. 8 is an illustrative diagram showing an example of the composition of a carriage and peripheral region of same.

FIG. 8 is a principal perspective diagram showing an example of the composition of the carriage 20 in FIG. 1 and the peripheral region thereof.

In FIG. 8, the reference numeral 86 indicates a guide shaft and reference numeral 88 indicates a guide rail. The carriage 20 is supported on a guide shaft 86, and is able to travel smoothly in a reciprocal fashion in the main scanning direction (the direction indicated by arrow M), along the guide shaft 86 and the guide rail 88 parallel to same. In this case, the carriage 20 moves back and forth reciprocally by means of the guide shaft 86 and the guide rail 88, while maintaining a uniform distance between the nozzle surface 82A (liquid ejection surface) of the head (100 in FIG. 1) which is conveyed by the carriage 20, and the recording medium (not illustrated).

Example of Inkjet Recording Apparatus in First Embodiment

Figure 9:
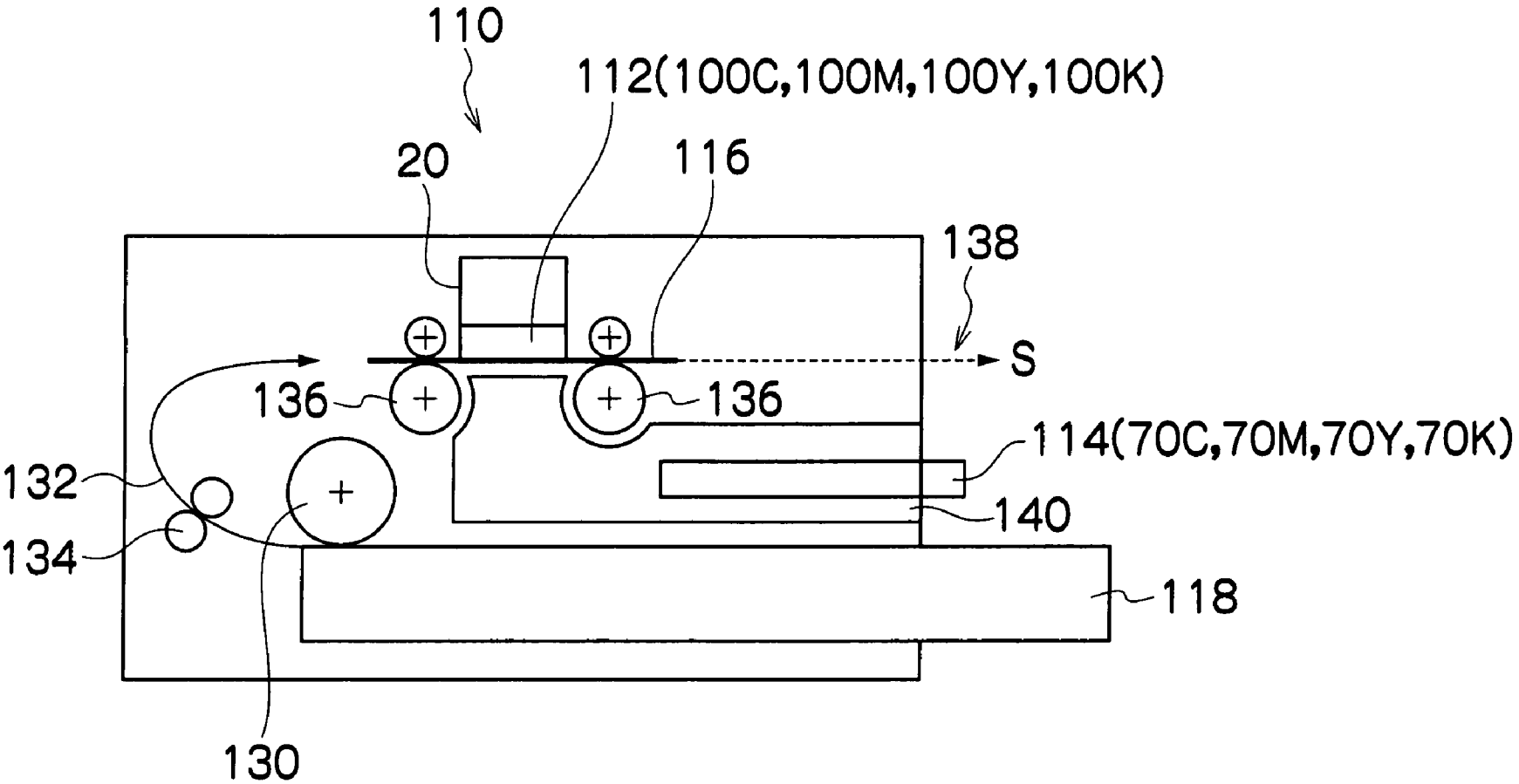
FIG. 9 is an organization drawing showing the general composition of an inkjet recording apparatus.

FIG. 9 is a mechanism drawing showing the general composition of an inkjet recording apparatus (image forming apparatus) relating to one embodiment of the present invention. As shown in FIG. 9, the inkjet recording apparatus 110 comprises: an ink ejection unit 112 having a plurality of heads 100C, 100M, 100Y and 100K provided respectively for the ink colors; an ink cartridge 114 having a plurality of main tanks 70C, 70M, 70Y and 70K provided respectively for the ink colors, which stores inks to be supplied to the respective heads 100C, 100M, 100Y and 100K; a paper supply unit 118 which supplies a recording medium 116; and a carriage 20 which is scanned (moved) in the main scanning direction, which is substantially perpendicular to the conveyance direction of the recording medium 116 (the sub-scanning direction S).

The heads 100C, 100M, 100Y and 100K of the respective colors are similar in structure to the head 100 illustrated as an example in FIG. 6 and FIG. 7, and further description thereof is omitted here.

The paper supply unit 118 in FIG. 9 uses a system based on a paper supply cassette which is loaded with cut paper that has been cut to a prescribed size. In order to print onto recording medium 116 of a plurality of sizes, the paper supply cassette fitted to the paper supply unit 118 is removed and replaced with a paper supply cassette loaded with recording medium 116 of the desired size. It is also possible to prepare cassettes loaded with recording medium 116 of the same size but different paper types.

The inkjet recording apparatus 110 is composed in such a manner that it can be used with recording medium of a plurality of types as described above, and by attaching an information recording body, such as a barcode or radio tag, which stores type information relating to the loaded recording medium 116, to the cassette, and reading in the information of this information recording body, by means of a prescribed reading apparatus, the inkjet recording apparatus 110 is able to judge automatically the type of recording medium being used, and hence the various units inside the apparatus can be controlled in accordance with the type of recording medium. For example, ink ejection may be controlled in such a manner that suitable ink ejection is achieved in accordance with the type of recording medium 116.

The recording medium 116 loaded in the paper supply unit 118 is conveyed to the conveyance path 132 by the rotation of the paper supply roller 130, and is then conveyed in the upward vertical direction by the conveyance rollers 134 provided in the conveyance path 132, while at the same time the front/rear surface orientation of the paper is reversed in the conveyance path 132 (the paper is turned once in the conveyance path 132) and the paper is conveyed to a position directly below the ink ejection unit 112. The recording medium 116 is then conveyed directly below the ink ejection unit 112 in a prescribed conveyance direction S (the sub-scanning direction) within a horizontal plane, at a uniform conveyance pitch, while being kept to a prescribed flatness by the conveyance rollers 136.

When the recording medium 116 arrives at a print region directly below the ink ejection unit 112, then printing in the main scanning direction is carried out by ejecting inks of respective colors from the nozzles provided on the surfaces of the heads 100K, 100C, 100M and 100Y which face the recording medium 116, while moving the carriage 124 for scanning in the main scanning direction. When one printing action in the main scanning direction has finished, the recording medium 116 is conveyed through a prescribed distance in the sub-scanning direction, and printing in the main scanning direction is carried out again while moving the carriage 20 in the main scanning direction. In this way, by repeating a printing action in the main scanning direction while conveying the recording medium 116 successively through a uniform pitch in the sub-scanning direction, a desired image is recorded on the whole surface of the recording medium 116. The recording medium 116 on which the desired image has been formed is then conveyed in a prescribed conveyance direction and output to the exterior of the apparatus from the paper output unit 138.

The ink cartridge 114 which stores inks to be supplied respectively to the heads 100K, 100C, 100M and 100Y (here, the main tank 70C which stores C ink, the main tank 70M which stores M ink, the main tank 70Y which stores Y ink, and the main tank 70K which stores K ink, are described collectively as the ink cartridge 114), is provided in a sub cartridge 140 which can be separated from the main body of the apparatus.

The inkjet recording apparatus 110 shown in the present embodiment has the structure in which a sub cartridge 140 in which an ink cartridge 114 is installed can be attached and detached to and from the main body of the apparatus via the front side of the apparatus. Furthermore, an ink cartridge introduction aperture for inserting the ink cartridge 114 is provided on the front surface of the sub cartridge 140 (the surface of the sub cartridge 140 which corresponds to the front surface of the apparatus when the sub cartridge 140 is installed in the main body of the apparatus), thereby forming the structure in which the operation of detaching and attaching (replacing) the ink cartridge 114 can be carried out via one surface (for instance, the front surface) of the apparatus.

Figure 10:
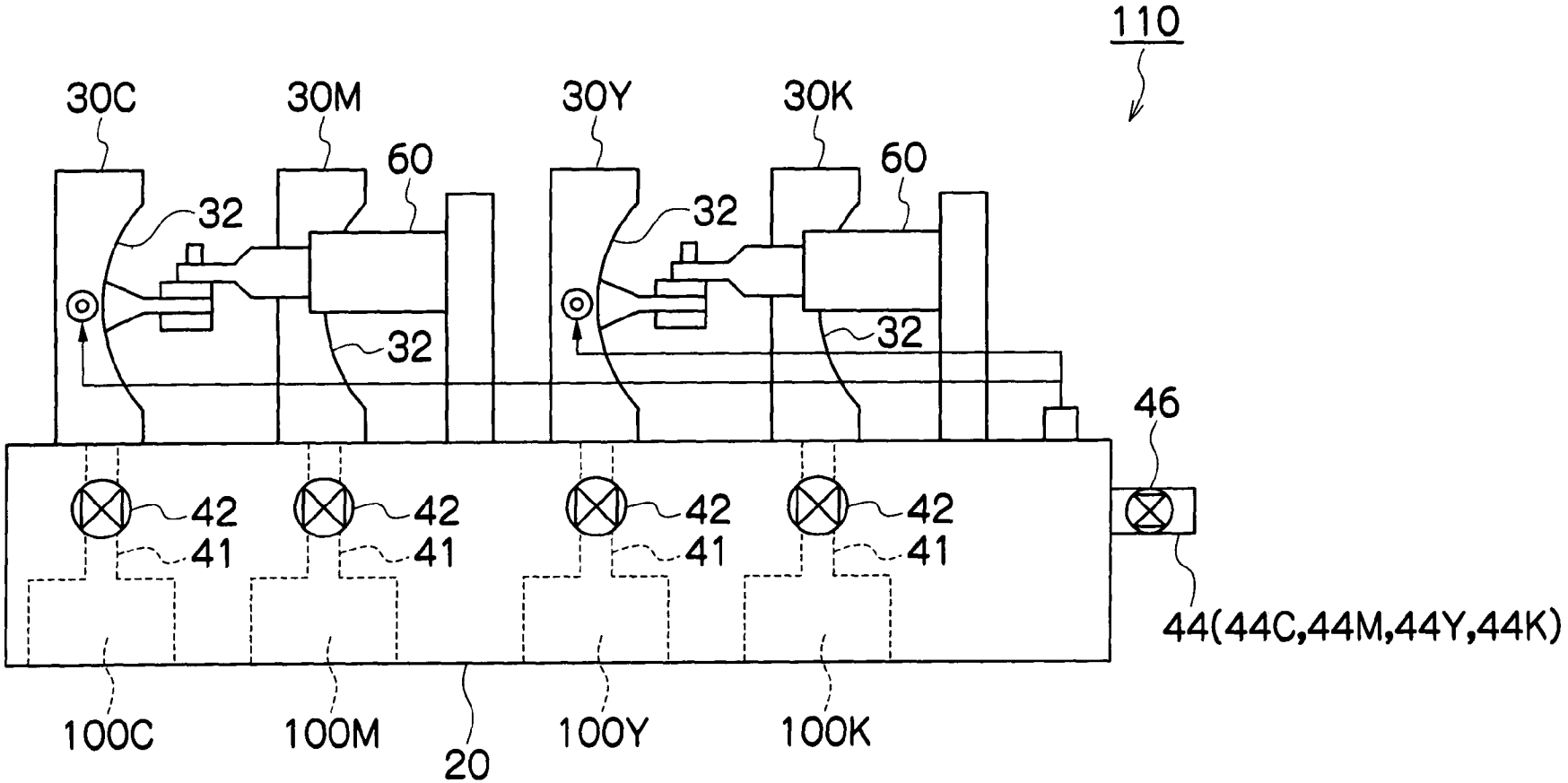
FIG. 10 is a plan diagram showing the principal part of one example of the inkjet recording apparatus relating to the first embodiment in a case where four colors of inks are used.

Carriage Corresponding to Inks of a Plurality of Colors and Peripheral Region of Same FIG. 10 is a side view showing a case where one carriage 20 conveys a total of four heads 100C, 100M, 100Y, and 100K which respectively eject inks of the respective colors of C, M, Y, and K.

In FIG. 10, four heads 100C, 100M, 100Y, and 100K are arranged in one carriage 20. Furthermore, four sub tanks 30C, 30M, 30Y and 30K which respectively supply C colored ink, M colored ink, Y colored ink and K colored ink to the four heads 100C, 100M, 100Y and 100K are arranged on the upper surface of one carriage 20.

Figure 11:
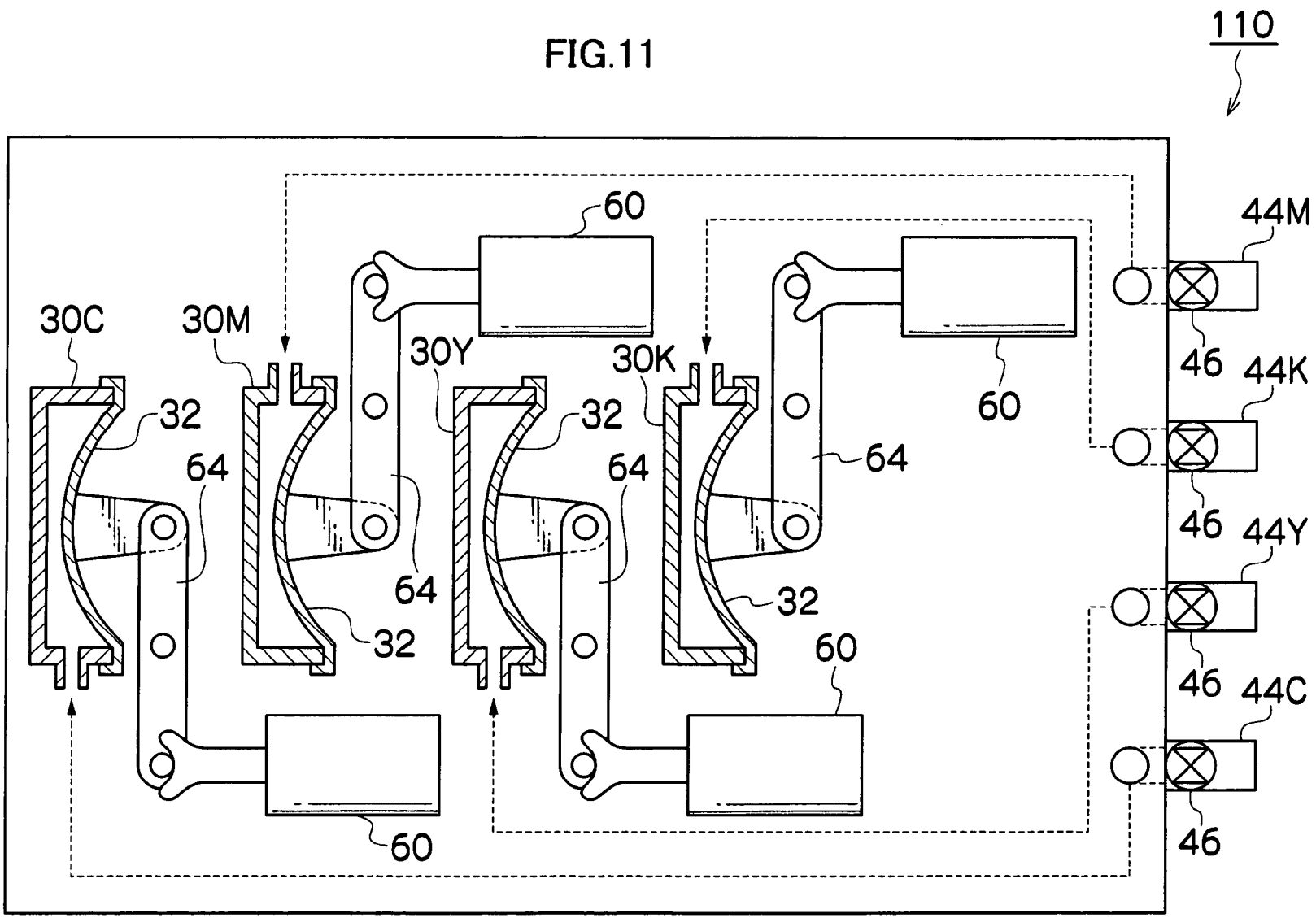
FIG. 11 is a side view diagram showing the principal part of one example of the inkjet recording apparatus relating to the first embodiment in a case where four colors of inks are used.

FIG. 11 shows a plan diagram of the carriage 20 in FIG. 10.

In FIG. 11, four ink supply receiving coupling sections 44C, 44M, 44Y and 44K are disposed on the side face of one carriage 20, in order to connect four sub tanks 30C, 30M, 30Y and 30K respectively to four main tanks (70C, 70M, 70Y and 70K in FIG. 9).

In FIG. 10 and FIG. 11, the liquid flow channels which respectively connect the four ink supply receiving coupling sections 44C, 44M, 44Y and 44K with the four sub tanks 30C, 30M, 30Y and 30K are not depicted, but rather are indicated by arrows.

Figure 12A:
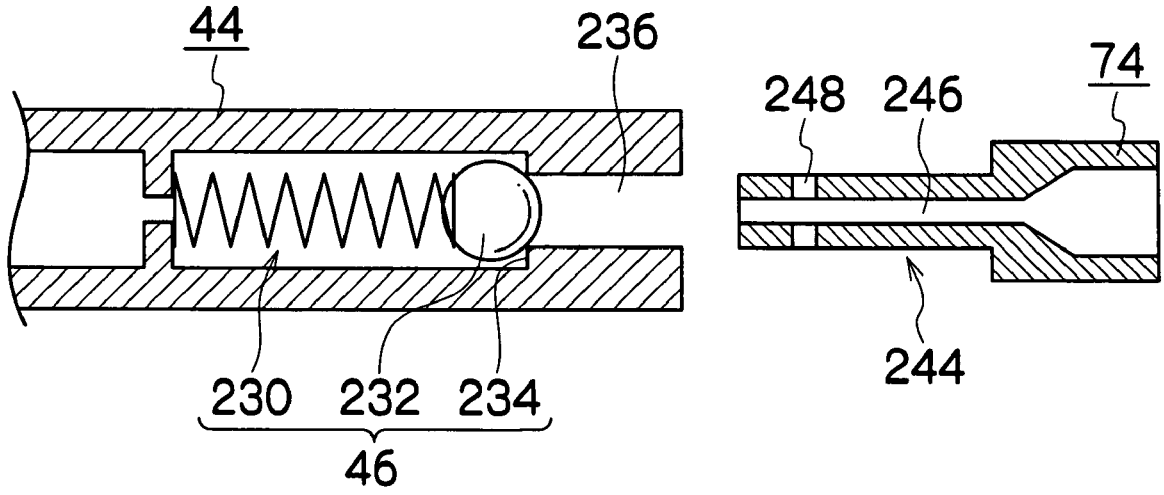
FIG. 12A is a cross-sectional diagram showing an example of the structure of an ink supply coupling section and an ink supply receiving coupling section which are separated from each other.
Figure 12B:
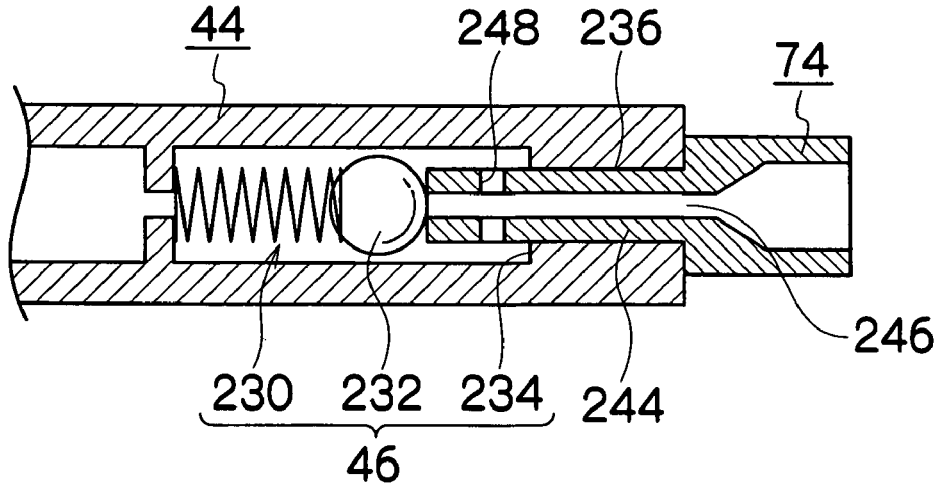
FIG. 12B is a cross-sectional diagram showing an example of the structure of an ink supply coupling section and an ink supply receiving coupling section which are coupled to each other.

Example of the Coupling Structure of Ink Supply Coupling Sections and Ink Supply Receiving Coupling Sections FIGS. 12A and 12B are cross-sectional diagrams showing an example of the coupling structure between an ink supply coupling section 74 provided on the main tank 70 side and an ink supply receiving coupling section 44 provided on the sub tank 30 side.

FIG. 12A shows a state where the ink supply coupling section 74 and the ink supply receiving coupling section 44 are separated, and FIG. 12B shows a state where the ink supply coupling section 74 and the ink supply receiving coupling section 44 are coupled together.

As shown in FIG. 12A, the interior of the ink supply receiving coupling section 44 has the structure of a non-reversing valve, in which a ball (valve body) 232 is impelled in the opposite direction to the inflow direction of the ink (namely, in the rightward direction in FIG. 12A) by means of the force of an elastic member (for example, a spring) 230, thereby causing the ball 232 to press up against a small-diameter end face (valve seating) 234 of the flow channel and thus sealing off the ink flow path.

On the other hand, the ink supply coupling section 74 which can fit into the ink supply receiving coupling section 44 has an ink supply needle 244 that can be inserted into an insertion aperture 236 of the ink supply receiving coupling section 44, and an opening hole 248 which connects with an internal flow channel 246 of the ink supply needle 244 is formed in the circumferential surface of the ink supply needle 244, in a position near the tip of the needle.

In the separated state shown in FIG. 12A, the flow channel of the insertion aperture 236 is closed off by the ball 232 which is impelled by the elastic member (for example, the spring) 230, and hence the valve assumes a closed state.

In the coupled state shown in FIG. 12B, by inserting the ink supply needle 244 into the insertion aperture 236, the ball 232 is pushed and moved in the opposite direction of the direction of impulsion of the elastic member 230, by the front tip of the ink supply needle 244, and therefore ink flows into the ink supply coupling section 44 via the opening hole 248 in the ink supply needle 244. In other words, in the coupled state shown in FIG. 12B, the valve assumes an open state by means of the ball 232, and hence the sub tank 30 and the main tank 70 shown in FIG. 1 assume a mutually connected state.

Description of Control System

Figure 13:
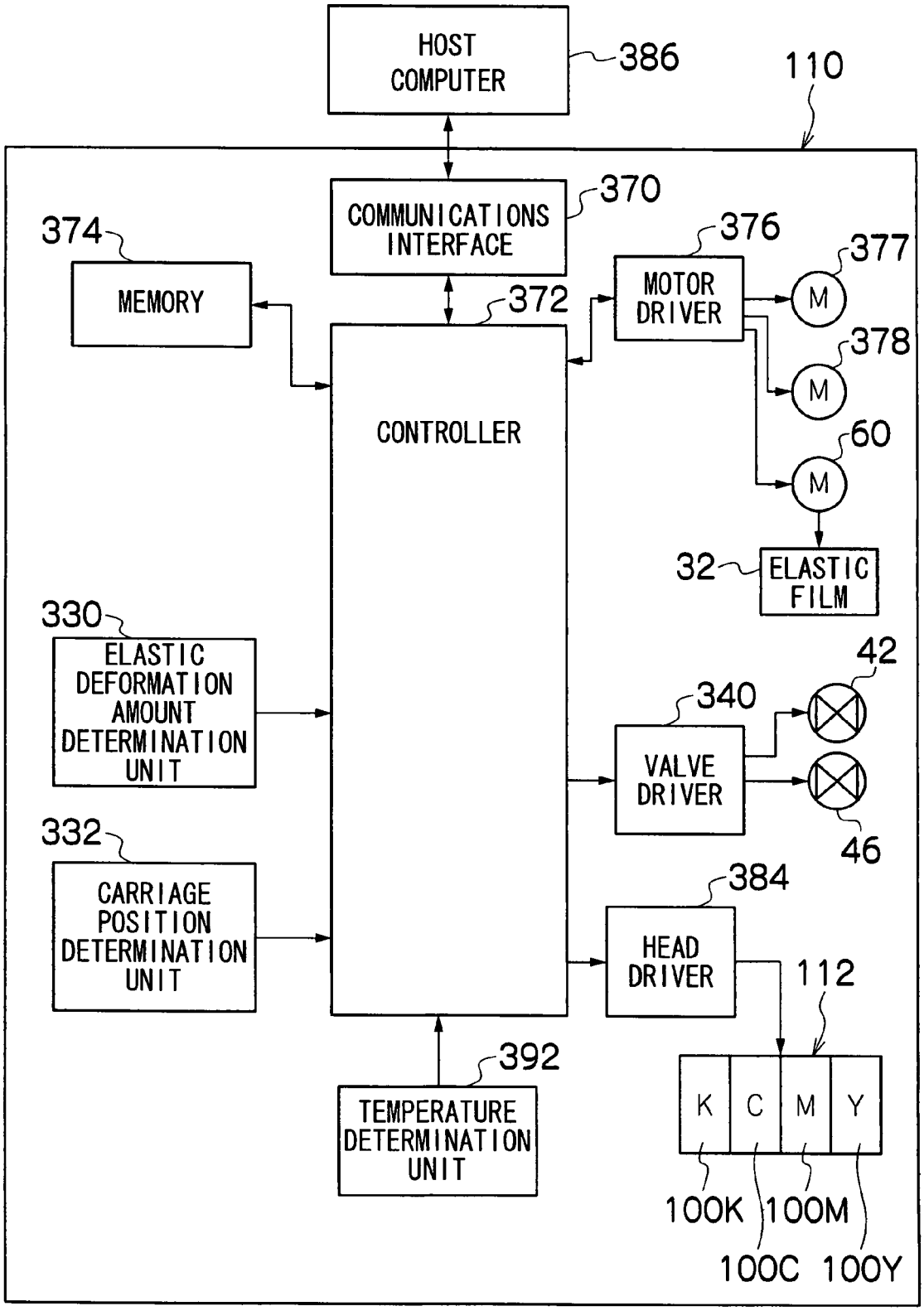
FIG. 13 is a block diagram of the inkjet recording apparatus relating to the first embodiment.

FIG. 13 is a block diagram showing the composition of the control system of the inkjet recording apparatus 110 according to the present embodiment.

In FIG. 13, the inkjet recording apparatus 110 according to the present embodiment comprises: an elastic deformation amount determination unit 330 which determines the amount of deformation (amount of displacement) of the elastic film 32 of the sub tank 30 shown in FIG. 1; a carriage position determination unit 332 which determines the position of the carriage 20 shown in FIG. 1, in the main scanning direction M; a valve driver 340 which drives the head opening and closing valve 42 and the sub tank opening and closing valve 46 shown in FIG. 1; a motor 377 which conveys the carriage 20 shown in FIG. 1 (hereinafter, called the "carriage conveyance motor"); a motor 378 which conveys the recording medium 116 shown in FIG. 9 (hereinafter, called the "medium conveyance motor"); a motor driver 376 which drives various motors, such as the linear movement motor 60 (elastic film movement motor), which causes the elastic film 32 of the sub tank 30 shown in FIG. 1 to move in a direction whereby the elastic film 32 recovers from elastic deformation; and a temperature determination unit 392 which determines the ambient temperature.

The elastic deformation amount determination unit 330 may use the strain gauge 33 as described in relation to FIG. 4, or it may use the optical sensors 34*a* and 34*b* as described in relation to FIG. 5A and FIG. 5B.

Furthermore, the elastic deformation amount determination unit 330 also serves as a remaining amount of ink determination unit which determines the remaining amount of ink in the sub tank 30. More specifically, the information on the amount of elastic deformation obtained from the elastic deformation amount determination unit 330 is information which reflects the remaining amount of ink inside the sub tank 30, and therefore, if it is determined on the basis of this information that the remaining amount of ink inside the sub tank 30 has become less than a prescribed amount, then replenishment of ink into the sub tank 30 is carried out by means of a pit-stop operation using the ink supply coupling section 74 shown in FIG. 1.

The valve driver 340 opens and closes the head opening and closing valve 42 shown in FIG. 1, and opens and closes the sub tank opening and closing valve 46, in accordance with instructions from the controller 372.

As shown in FIG. 13, the inkjet recording apparatus 110 comprises a communications interface 370, a controller 372, a memory 374, a head driver 384, and the like.

The communications interface 370 receives image data transmitted by a host computer 386. For the communications interface 370, various interfaces, such as USB (Universal Serial Bus), IEEE 1394, an Ethernet®, or a wireless network, or the like, can be used. Image data sent from the host computer 386 is read into the inkjet recording apparatus 110 via the communications interface 370, and it is stored in the memory 374.

The controller 372 is a control device which controls the sections, such as the communications interface 370, the memory 374, the valve driver 340, the motor driver 376, the head driver 384, and the like. The controller 372 is constituted by a central processing unit (CPU) and peripheral circuits relating to same, and the like.

The memory 374 is constituted by a RAM, ROM, EEPROM, and/or the like. The programs executed by the controller 372 and the various types of data which are required for control procedures are stored in this memory 374.

The motor driver 376 is a drive circuit which drives the carriage conveyance motor 377, the medium conveyance motor 378, and the linear movement motor 60 (the elastic film movement motor), in accordance with instructions from the controller 372.

Furthermore, the controller 372 functions as a signal processing device which carries out various treatments, corrections and other processing in order to generate ink ejection data for the head 100, on the basis of the image data (for example, image data for respective colors of R, G and B) in the memory 374. The controller 372 supplies the ink ejection data thus generated to the head driver 384.

The head driver 384 drives the pressurization elements (108 in FIG. 7) of the heads 100C, 100M, 100Y and 100K of the respective ink colors, on the basis of the ink ejection data supplied by the controller 372.

The temperature determination unit 392 is constituted by a temperature sensor, and determines the ambient temperature as the ink temperature.

Liquid Supply Process

Figure 14:
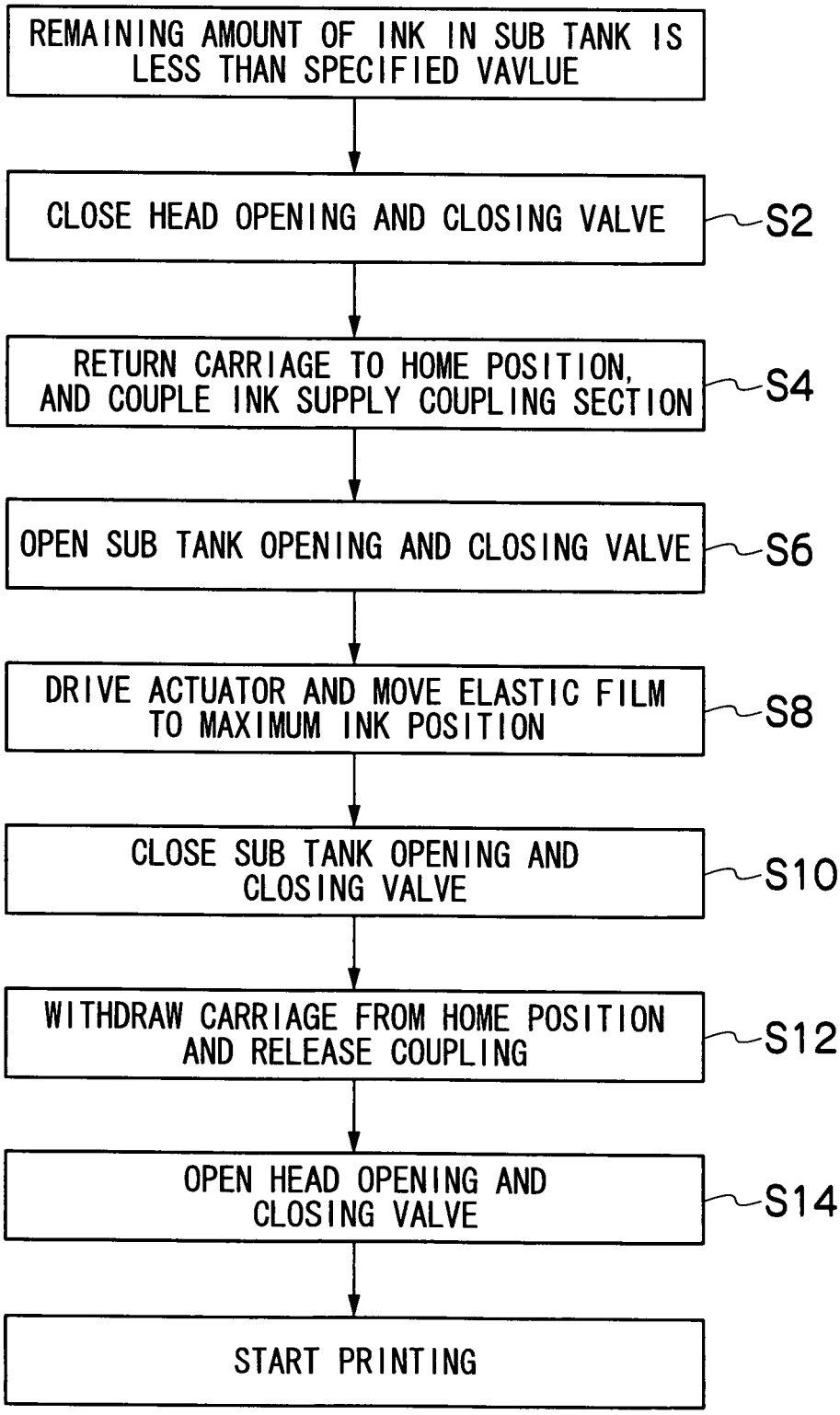
FIG. 14 is a flowchart showing the sequence of one example of a liquid supply process after initial filling according to the first embodiment.

FIG. 14 is a flowchart showing the sequence of one example of a liquid supply process after initial filling in the present embodiment. This liquid supply process is carried out under the control of the controller 372 in FIG. 13, in accordance with a program which is previously stored in the memory 374 shown in FIG. 13. Here, it is assumed that ink has already been filled initially from the main tank 70 to the sub tank 30 in FIG. 1, and furthermore, that ink has already been filled initially from the sub tank 30 to the head 100.

Figure 2A:
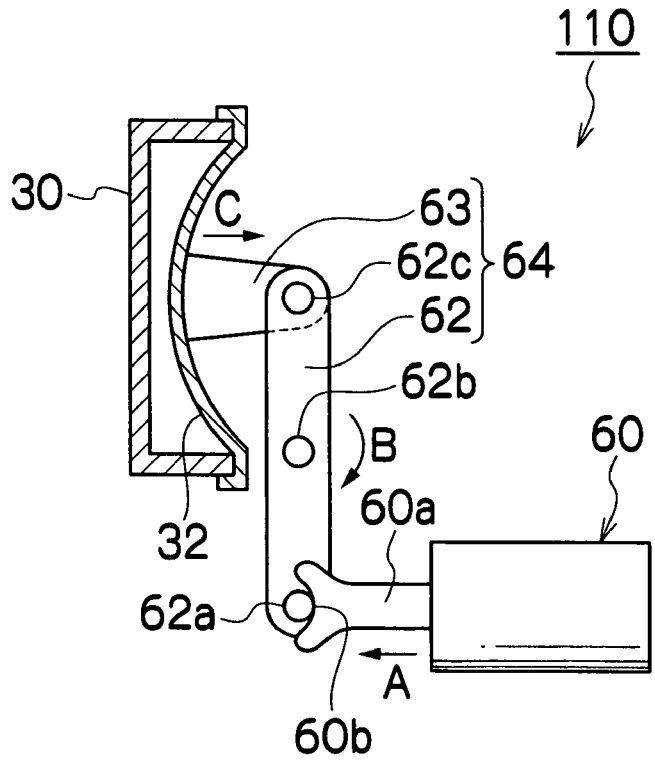
Figure 2B:
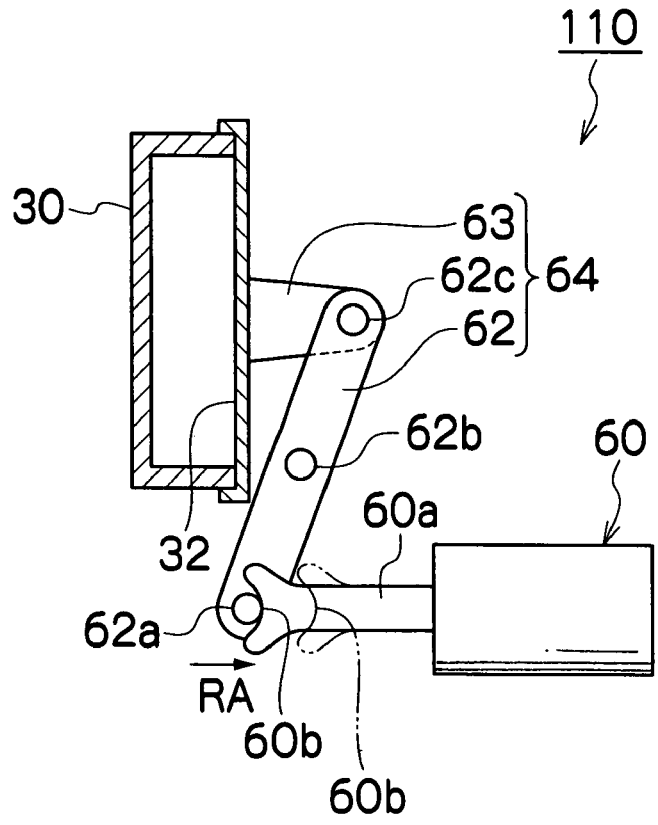

Immediately after initial filling, as shown in FIG. 2B, the sub tank 30 is in a state where it accommodates a maximum amount of ink, and the elastic film 32 is in a state where it has recovered from elastic deformation. In this case, in the elastic deformation amount determination unit 330 shown in FIG.

13, the maximum ink position is determined and a "maximum ink position signal" is output. In FIG. 2B, the linear movement shaft 60*a* of the linear movement motor 60 is retracted in the direction indicated by arrow RA, and the engagement between the linear movement shaft 60*a* of the linear movement motor 60 and the engaging section 62*a* of the arm 64 is released. The elastic film 32 of the sub tank 30 is maintained at the maximum ink position, due to its elastic force. In FIG. 2B, in order to aid understanding of the present embodiment, a state where there is absolutely no elastic deformation of the elastic film 32 (a state where there is no bending of the elastic film 32) is depicted as the maximum ink position, but the invention is not limited in particular to a case of this kind, and a state where there is a little elastic deformation in the elastic film 32 (a state where there is a little bending of the elastic film 32) may also be taken as the maximum ink position.

Furthermore, immediately after initial filling of ink, the sub tank opening and closing valve 46 shown in FIG. 1 assumes a closed state, the head opening and closing valve 42 assumes an open state, and the coupling between the ink supply coupling section 74 and the ink supply receiving coupling section 44 is in a released state.

Thereupon, when ink is ejected from the head 100 shown in FIG. 1, the ink is supplied from the sub tank 30 to the head 100, the amount of ink inside the sub tank 30 becomes lower and elastic deformation occurs in the elastic film 32 of the sub tank 30. The amount of elastic deformation gradually increases in accordance with the amount of ink supplied from the sub tank 30 to the head 100.

The controller 372 in FIG. 13 judges whether or not the remaining amount of ink in the sub tank 30 in FIG. 1 is less than a specified value, by comparing the amount of elastic deformation determined by the elastic deformation amount determination unit 330 (more specifically, by the strain gauge 33 shown in FIG. 4 or the optical sensors 34*a* and 34*b* shown in FIGS. 5A and 5B), with a maximum tolerable value previously stored in the memory 374 (namely, a threshold value corresponding to the minimum ink position). If the remaining amount of ink in the sub tank 30 has become less than the specified value, in other words, if the amount of elastic deformation of the elastic film 32 has become greater than the maximum tolerable value as shown in FIG. 2A, then the steps S2 to S14 in FIG. 14 are carried out.

Firstly, the head opening and closing valve 42 shown in FIG. 1 is closed by means of the valve driver 340 in FIG. 13 (S2). In other words, the head liquid supply flow channel 41 between the head 100 and the sub tank 30 in FIG. 1 is closed.

Thereupon, by driving the carriage conveyance motor 377 by means of the motor driver 376 shown in FIG. 13, the carriage 20 in FIG. 1 is moved in the main scanning direction M and returned to the prescribed home position, and furthermore, the ink supply coupling section 74 is coupled to the ink supply receiving coupling section 44 of the carriage 20 (S4). In other words, in FIG. 1, by means of the recess section 74*a* of the ink supply coupling section 74 fitting together with the projection-shaped ink supply receiving coupling section 44, the sub tank liquid supply flow channel 72 connected to the main tank 70 becomes coupled to the sub tank 30.

Thereupon, the sub tank opening and closing valve 46 shown in FIG. 1 is opened by means of the valve driver 340 in FIG. 13 (S6). In other words, the liquid flow channel 72 between the main tank 70 and the sub tank 30 is opened by opening the sub tank supply receiving flow channel 43 between the ink supply receiving coupling section 44 and the sub tank 30.

Thereupon, by driving the linear movement motor 60 by means of the motor driver 376 in FIG. 13, the elastic film 32 is moved in the direction of the arrow C, via the arm 64, until reaching the maximum ink position, as shown in FIG. 2A, thereby assisting the deformation recovery of the elastic film 32 (S8). By so doing, as shown in FIG. 2B, the amount of elastic deformation of the elastic film 32 becomes a minimum value, and a minimum ink position signal is output from the elastic deformation amount determination unit 330 shown in FIG. 13 (more specifically, the strain gauge 33 shown in FIG. 4 or the optical sensor 34*a* and 34*b* shown in FIGS. 5A and 5B).

Thereupon, the sub tank opening and closing valve 46 shown in FIG. 1 is closed by means of the valve driver 340 in FIG. 13 (S10). In other words, the liquid flow channel 72 between the main tank 70 and the sub tank 30 is closed by closing the sub tank supply receiving flow channel 43 between the ink supply receiving coupling section 44 and the sub tank 30.

Thereupon, by driving the carriage conveyance motor 377 by means of the motor driver 376 shown in FIG. 13, the carriage 20 in FIG. 1 is moved in the main scanning direction M and withdrawn from the home position, and furthermore, the coupling between the ink supply coupling section 74 and the ink supply receiving coupling section 44 of the carriage 20 is released (S12). In other words, the recess section 74*a* of the ink supply coupling section 74 separates from the projection-shaped ink supply receiving coupling section 44.

Thereupon, the head opening and closing valve 42 shown in FIG. 1 is opened by means of the valve driver 340 in FIG. 13 (S14). In other words, the head liquid supply flow channel 41 between the head 100 and the sub tank 30 in FIG. 1 is opened.

In so doing, the internal pressure of the sub tank 30 and the head 100 in FIG. 1 is set to a prescribed initial value (initial negative pressure), whereupon printing can be started.

It is desirable that the initial negative pressure of the sub tank 30 should be switched in accordance with the print mode, or the ambient temperature, or the ink temperature or the ink viscosity.

FIG. 15 shows an example of the initial negative pressure settings in the sub tank 30 corresponding to the print mode. For example, if the print mode managed by the controller 372 is a high-speed mode, then the initial negative pressure of the sub tank 30 is set to −150 $mmH_2O$, and if it is a high-quality mode in which the conveyance speed of the carriage 20 is lower than in the high-speed mode, then the initial negative pressure of the sub tank 30 is set to −80 $mmH_2O$.

FIG. 16 shows an example of the initial negative pressure settings in the sub tank 30 corresponding to the ambient temperature. For example, if the ambient temperature determined by the temperature determination unit in FIG. 13 is equal to or greater than 15° C., then the ink viscosity is high, and therefore the initial negative pressure of the sub tank 30 is set to −150 $mmH_2O$, whereas if the temperature is less than 15° C., the ink viscosity is low, and therefore the initial negative pressure of the sub tank 30 is set to −80 $mmH_2O$. Apart from a mode where the set value of the initial negative pressure of the sub tank 30 is switched on the basis of the ambient temperature, similar beneficial effects are obtained in a mode where the ink temperature is measured directly and the set value of the initial negative pressure of the sub tank 30 is switched on the basis of the measurement value of the ink temperature, a mode where the ink viscosity is determined on the basis of the measured ambient temperature or ink temperature, and the set value of the initial negative pressure of the sub tank 30 is switched on the basis of the ink viscosity, or a mode where the ink viscosity is measured directly and the set value of the initial negative pressure of the sub tank 30 is switched on the basis of the measurement value of the ink viscosity.

More specifically, the internal pressure of the sub tank 30 is set in this fashion by switching the amount of linear driving of the linear movement motor 60 in the direction of arrow A in FIG. 2A by means of the motor driver 376 in FIG. 13. More specifically, the initial negative pressure of the sub tank 30 is set by means of the linear movement motor 60 (elastic body movement device).

Second Embodiment

Figure 17A:
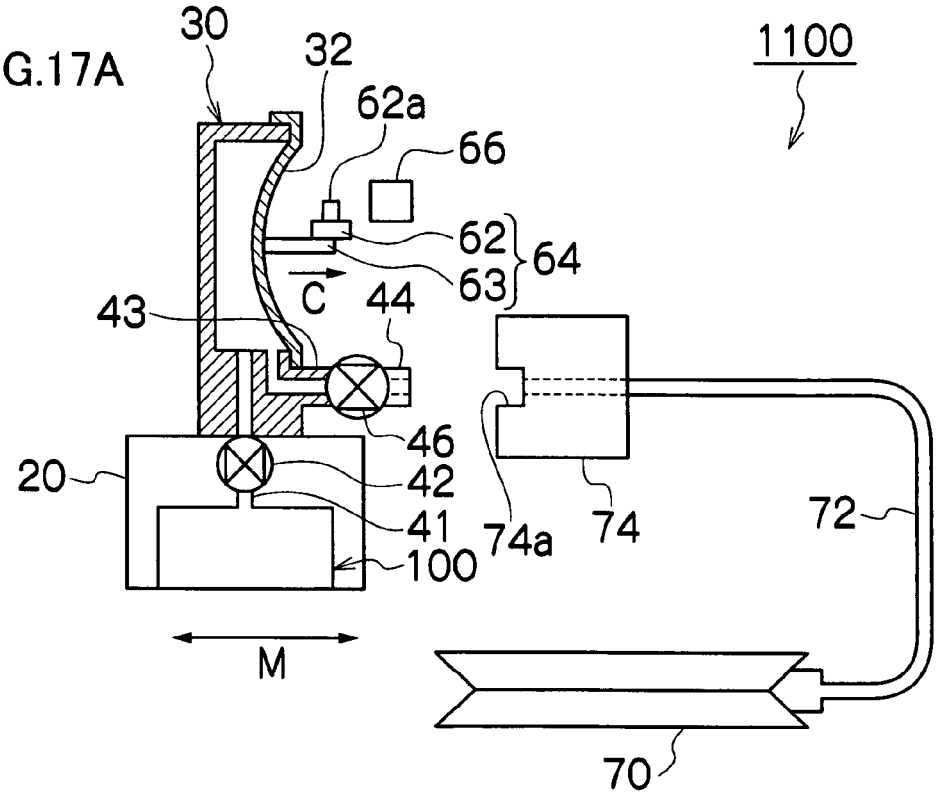
Figure 17B:
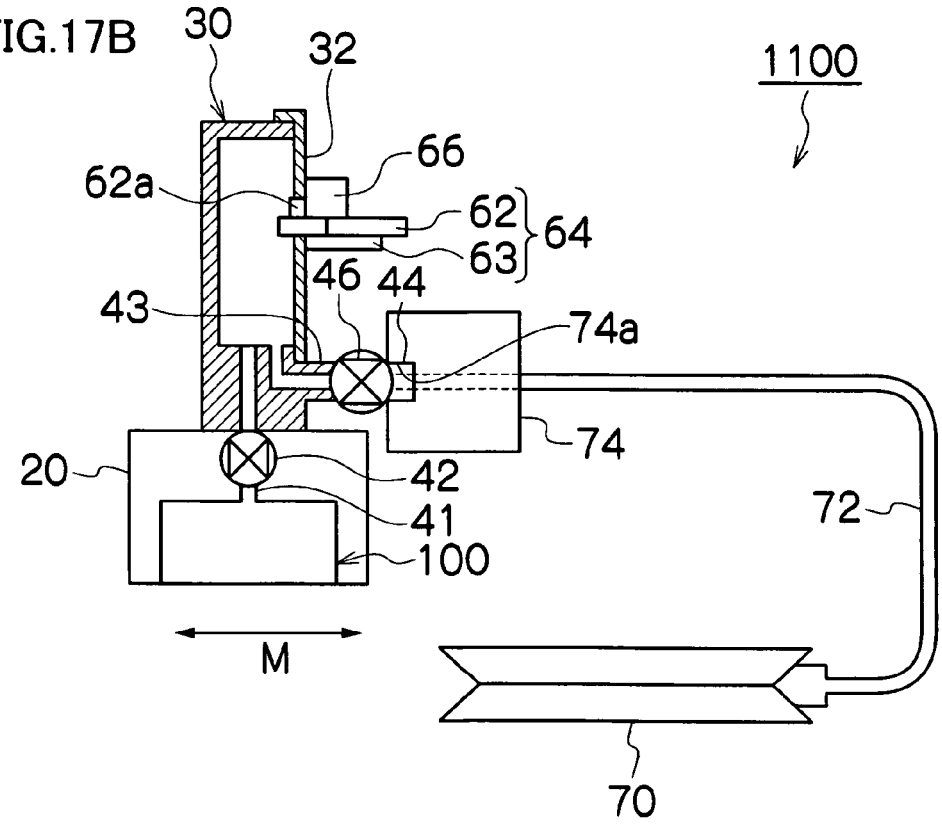

FIGS. 17A and 17B are side views showing the principal part of an inkjet recording apparatus 1100 which forms one example of a second embodiment of the present invention. FIGS. 17A and 17B show views where the carriage 20 which conveys the head 100 is observed from the side, and in order to facilitate understanding of the present embodiment, the internal portion of the carriage 20 is depicted in a schematic view and the sub tank 30 is depicted in a vertical cross-sectional view. FIG. 17A shows a state where the elastic film 32 has deformed elastically, and FIG. 17B shows a state where the elastic film 32 has recovered from the elastic deformation. In FIGS. 17A and 17B, the same reference numerals are assigned to constituent elements which are the same as those of inkjet recording apparatus 110 relating to the first embodiment shown in FIG. 1, and description of details already explained above is omitted here.

In the present embodiment, a movement operation of the carriage 20 in the main scanning direction M is used to open and close the head opening and closing valve 42, and thereby to open and close the head liquid supply flow channel 41 between the head 100 and the sub tank 30. Furthermore, a movement operation of the carriage 20 in the main scanning direction M is used to couple the ink supply coupling section 74 with the ink supply receiving coupling section 44. Moreover, a movement operation of the carriage 20 in the main scanning direction M is also used to move the elastic film 32 of the sub tank 30 in the direction indicated by arrow C (in other words, a direction whereby the film recovers from the elastic deformation).

Figure 18A:
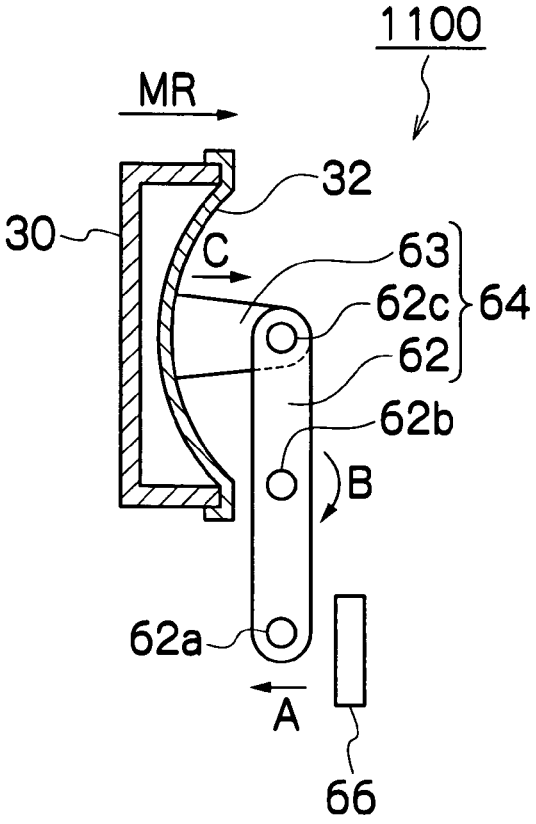
Figure 18B:
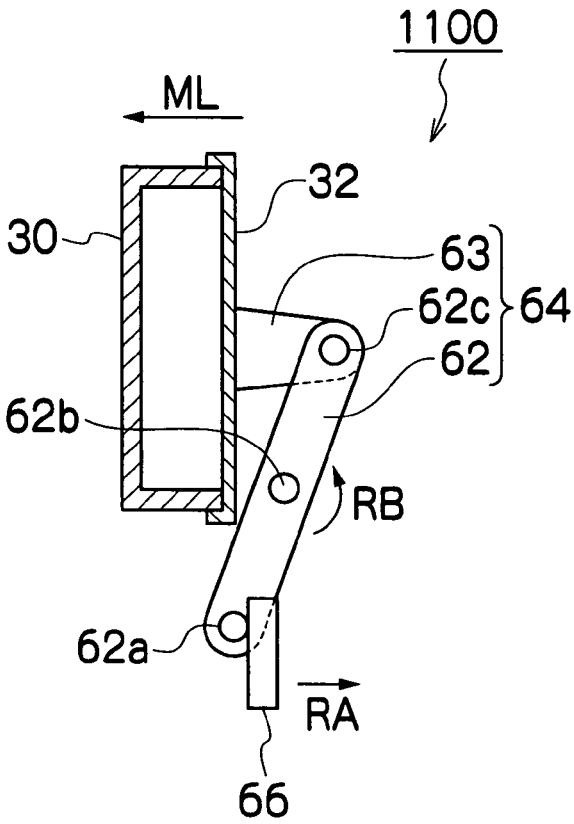

FIGS. 18A and 18B are plan diagrams which correspond respectively to FIGS. 17A and 17B. FIGS. 18A and 18B show views of the carriage 20 as observed from above, and in order to facilitate understanding of the present embodiment, the sub tank 30 is depicted in a horizontal cross-section.

FIG. 18A shows a state where the elastic film 32 has deformed elastically, and FIG. 18B shows a state where the elastic film 32 has recovered from the elastic deformation.

In FIG. 18A, when the carriage 20 moves in the direction indicated by arrow MR in the main scanning direction, an arm abutting member 66 fixed to the main body of the inkjet recording apparatus 110 abuts against (engages with) a projection-shaped engaging section 62*a* provided on a rotating section 62 of an arm 64. In so doing, the rotating section 62 of the arm 64 rotates in a clockwise direction as indicated by arrow B, and the linear movement section 63 of the arm 64 is moved in the direction indicated by arrow C (a direction which causes the elastic film 32 to recover from elastic deformation).

Figure 19:
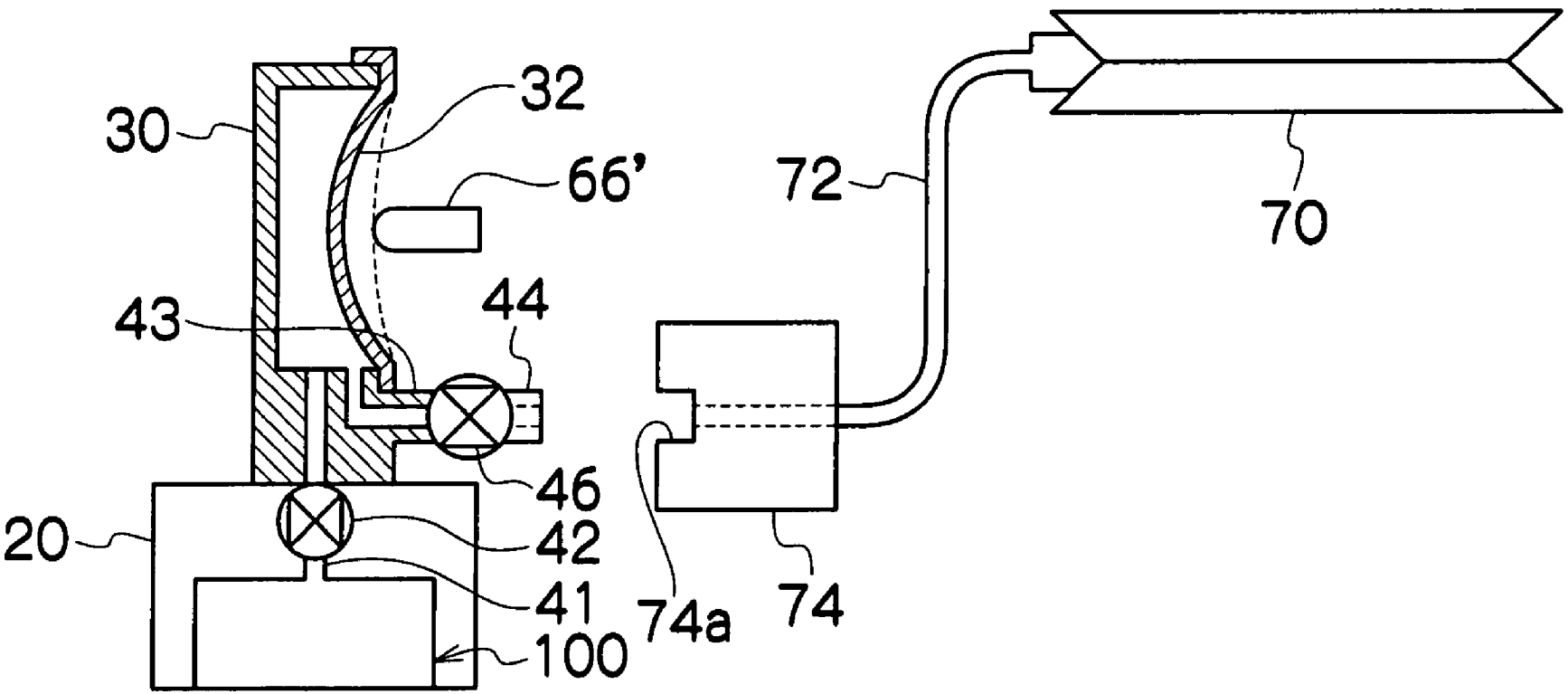
FIG. 19 a side view diagram showing the principal part of a further example of the inkjet recording apparatus relating to the second embodiment.

FIGS. 17A and 17B and FIGS. 18A and 18B show examples where the arm abutting member 66 moves the elastic film 32 by means of the arm 64, but the present invention is not limited to this. As shown in FIG. 19, it is also possible to adopt a composition in which an abutting member 66' abuts directly against the elastic film 32. Furthermore, the main tank 70 may also be provided in a position higher than the liquid ejection surface of the head 100.

Figure 20:
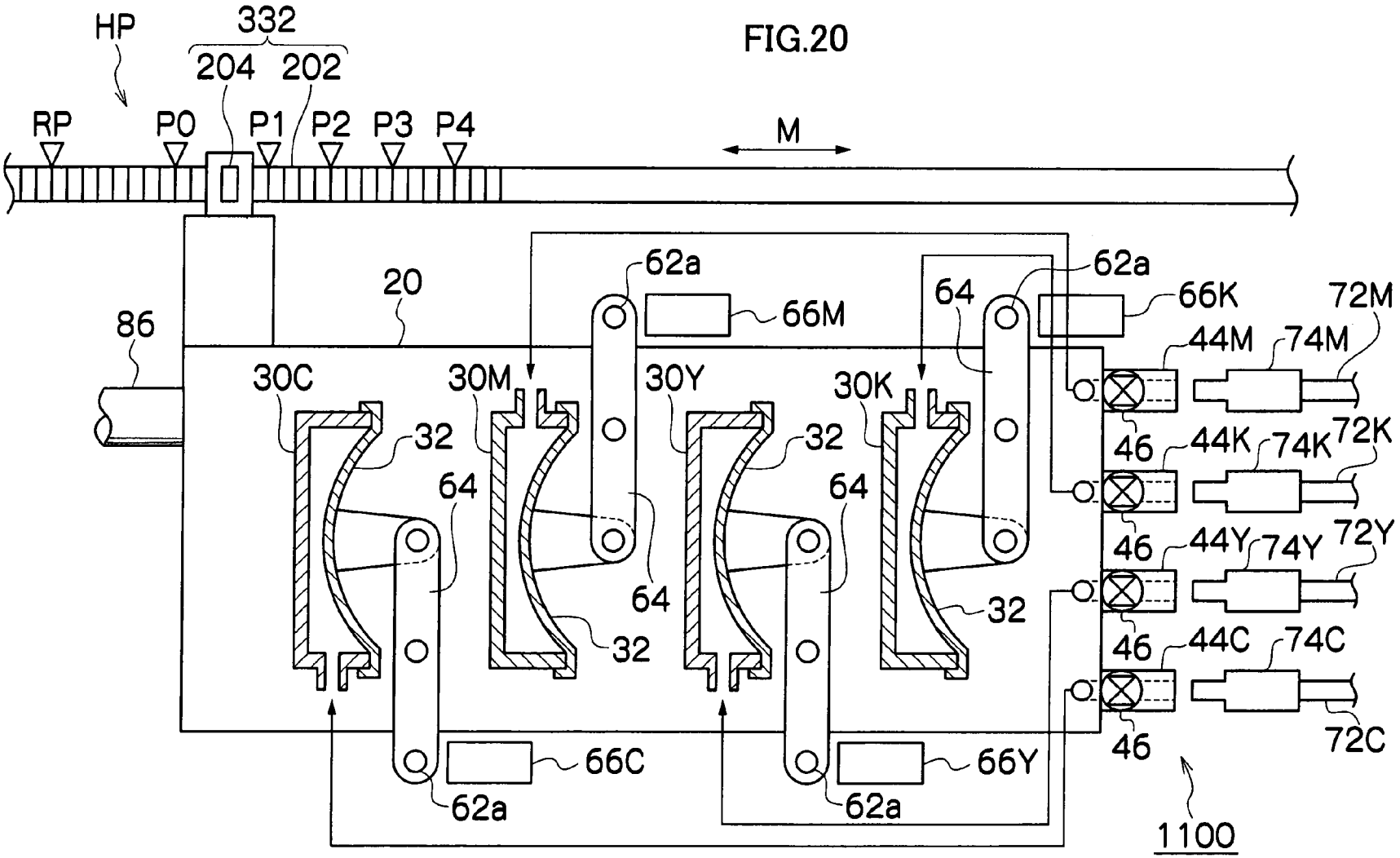
FIG. 20 is a plan diagram showing the principal part of one example of the inkjet recording apparatus relating to the second embodiment in a case where four colors of inks are used.
Figure 21:
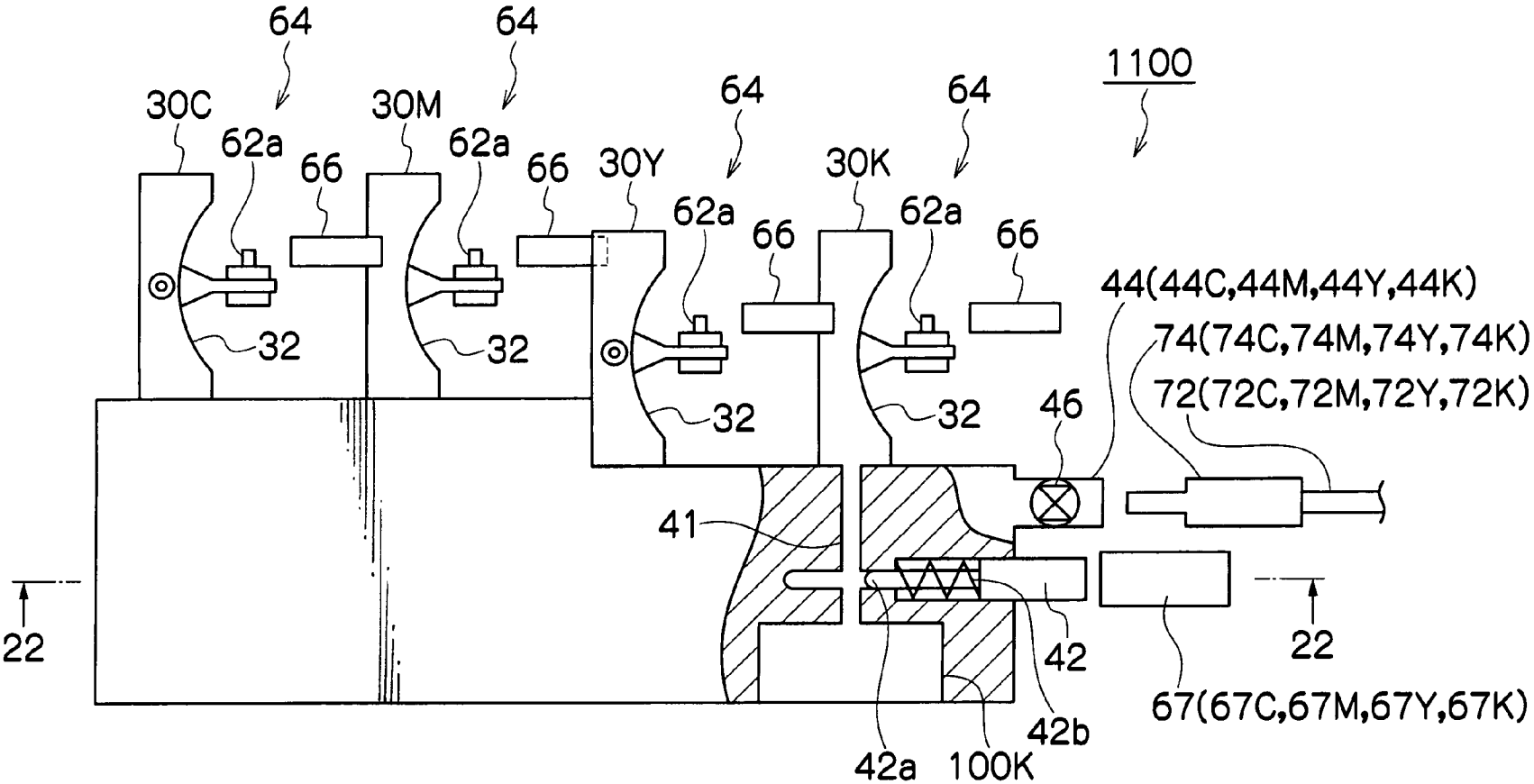
FIG. 21 is a side view diagram showing the principal part of one example of the inkjet recording apparatus relating to the second embodiment in a case where four colors of inks are used.
Figure 22:
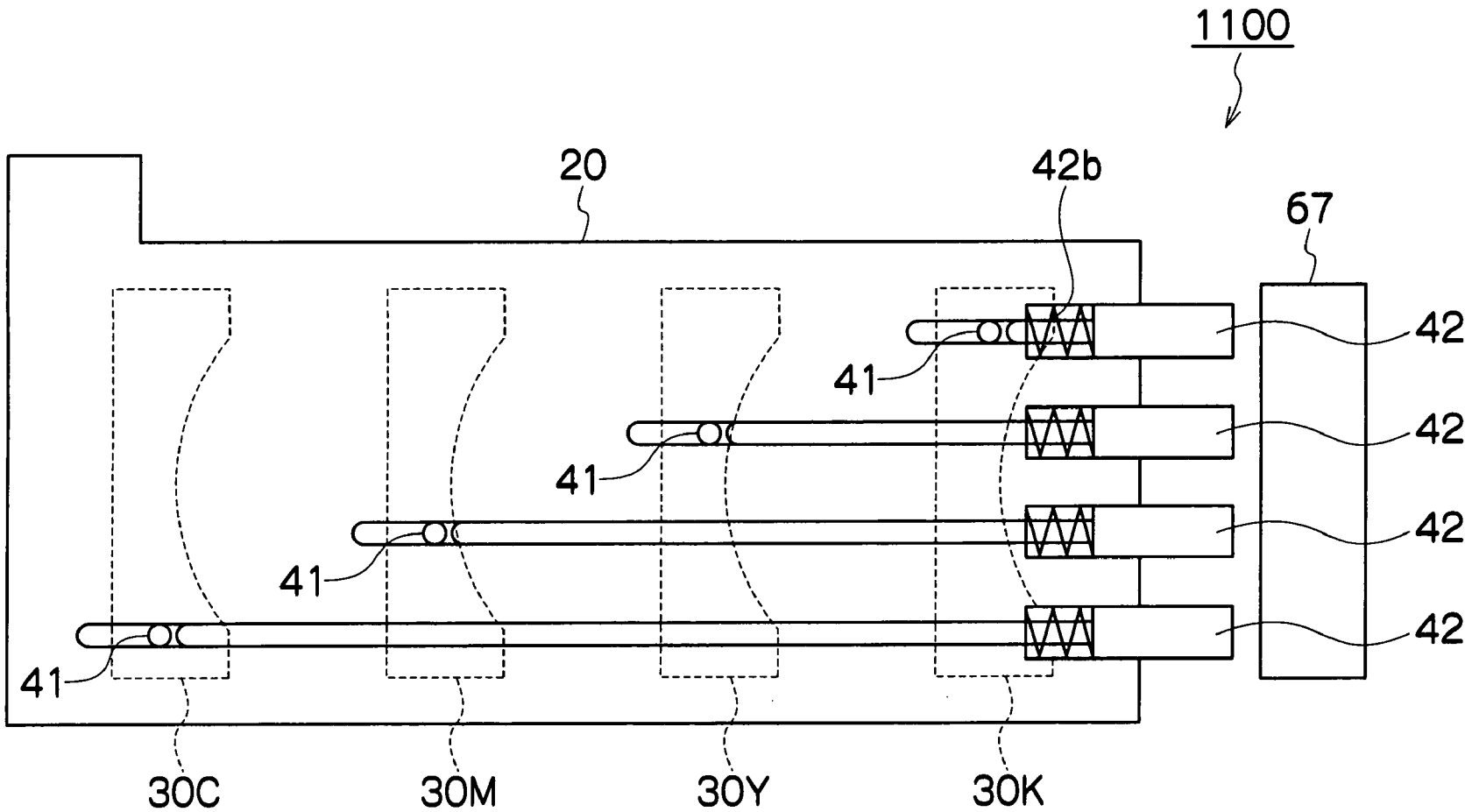
FIG. 22 is a horizontal cross-sectional diagram along line 22-22 in FIG. 21.

FIG. 20 is a plan diagram showing the principal part of the inkjet recording apparatus 1100 according to the present embodiment, in a case where inks of four colors (C colored ink, M colored ink, Y colored ink and K colored ink) are used. FIG. 21 is a side view diagram showing the principal composition of the inkjet recording apparatus 1100 shown in FIG. 20. In FIG. 21, a region between one sub tank 30K and one liquid ejection head 100K is depicted in cross-sectional view. FIG. 22 shows a horizontal cross-section along line 22-22 in FIG. 21.

In FIG. 20, the carriage 20 has four sub tanks 30 (30C, 30M, 30Y and 30K) for the respective ink colors (C, M, Y, K), and four ink supply receiving coupling sections 44 (44C, 44M, 44Y and 44K) for the respective ink colors.

Four ink supply coupling sections 74 (74C, 74M, 74Y and 74K) for the respective ink colors respectively fit together with the four ink supply receiving coupling sections 44 of the respective ink colors (44C, 44M, 44Y and 44K). The sub tank liquid supply flow channels 72 (72C, 72M, 72Y and 72K in FIG. 20) which are connected respectively to the four main tanks 70 (70C, 70M, 70Y and 70K) of the respective ink colors in FIG. 9 are coupled respectively to the four sub tanks 30 (30C, 30M, 30Y and 30K in FIG. 20) of the respective ink colors by means of the four ink supply coupling sections 74 (74C, 74M, 74Y and 74K in FIG. 20) of the respective ink colors. The ink supply coupling sections 74 and the ink supply receiving coupling sections 44 use the coupling structure shown in FIG. 12A and FIG. 12B, for example.

As shown in FIG. 20, a prescribed original home position P0 (corresponding to HP in FIG. 8) for the carriage 20 is provided in a position which is withdrawn from the liquid ejection region in the main scanning direction M.

Figure 23:
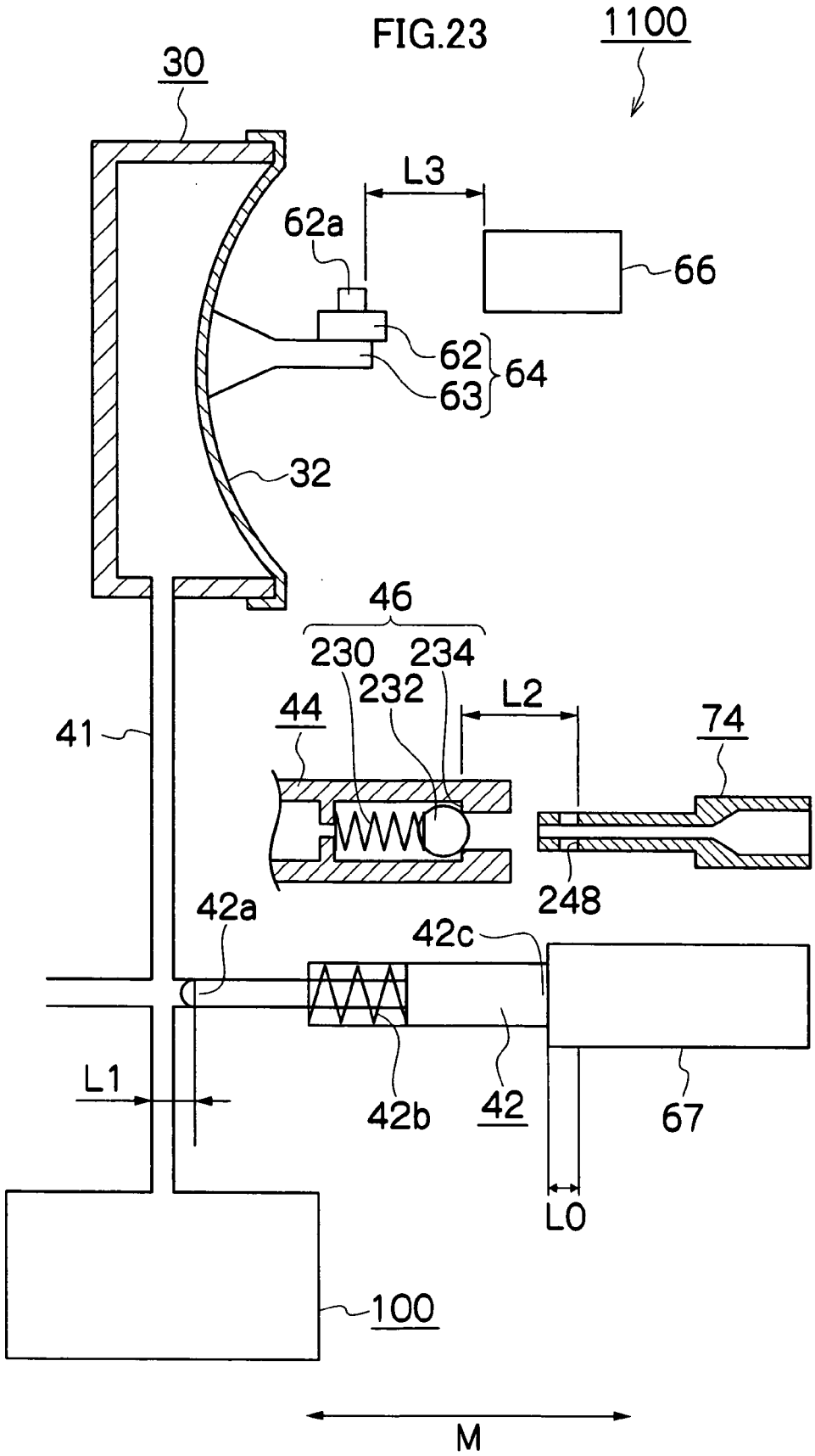
FIG. 23 is an illustrative diagram used to describe the positional relationship between a carriage and members on the main body, in the inkjet recording apparatus relating to the second embodiment.

Furthermore, a home position P1 for the carriage 20 (also called "head closed position") where the head opening and closing valves (42 in FIG. 21 and FIG. 22) are closed is also provided in a position which is withdrawn from the liquid ejection region in the main scanning direction M and which is distanced further from the liquid ejection region than the original home position P0. In a state where the carriage 20 has moved from the original home position P0 to the head closed position P1, as shown in FIG. 23, a valve abutting member 67 fixed to the main body of the inkjet recording apparatus 1100 abuts against the end portions 42*c* of the head opening and closing valves 42 which project from the carriage 20, the head opening and closing valves 42 is closed, and thereby the head liquid supply flow channels 41 between the sub tanks 30 and the head 100 are closed.

Furthermore, as shown in FIG. 20, a home position P2 for the carriage 20 (also called "ink supply coupling position") where the sub tank liquid supply flow channels 72 (72C, 72M, 72Y and 72K) couple with the sub tanks 30 (30C, 30M, 30Y and 30K) is provided in a position which is withdrawn from the liquid ejection region in the main scanning direction M and which is distanced further from the liquid ejection region than the head closed position P1. In a state where the carriage 20 has been moved from the head closed position P1 to the ink supply coupling position P2, the ink supply coupling sections 74 on the main tanks 70 side fit together with the ink supply receiving coupling sections 44 on the carriage 20 side.

Furthermore, a deformation recovery start position P3 for the carriage 20 (which corresponds to a "minimum ink position" of the elastic film 32) where the elastic films 32 of the sub tanks 30 start to recover from deformation is provided in a position which is withdrawn from the liquid ejection region in the main scanning direction M and is distanced further from the liquid ejection region than the ink supply coupling position P2. In a state where the carriage 20 has moved from the ink supply coupling position P2 to the deformation recovery start position P3, the arm abutting members 66 which has been separated from the engaging sections 62*a* of the arms 64 in FIG. 20 and FIG. 21 respectively abut against (engage with) the engaging sections 62*a* of the arms 64.

Furthermore, a deformation recovery end position P4 for the carriage 20 (which corresponds to a "maximum ink position" of the elastic film 32) at which the elastic films 32 of the sub tanks 30 end recovery from deformation is also provided in a position which is withdrawn from the liquid ejection region in the main scanning direction M and is distanced further from the liquid ejection region than the deformation recovery start position P3. In a state where the carriage 20 has been moved from the deformation recovery start position P3 to the deformation recovery end position P4, the elastic films 32 of the sub tanks 30 have recovered from elastic deformation and the amount of ink in the sub tanks 30 has become a maximum, as shown in FIG. 18B.

Furthermore, a return position RP for the carriage 20 at which the carriage 20 performs a return operation is provided in a position which is withdrawn from the liquid ejection region in the main scanning direction M and is nearer to the liquid ejection region than the original home position P0.

A linear encoder 202 is disposed following the direction of movement of the carriage 20 (in other words, the main scanning direction M), and an optical sensor 204 is installed on the carriage 20. The linear encoder 202 has bars which can be determined by the optical sensor 204. The bars of the linear encoder 202 are arranged in the main scanning direction M, extending from at least the return position RP until the deformation recovery end position P4. A carriage position determination unit 332 is constituted by the linear encoder 202 and the optical sensor 204.

If the amount of deformation of the elastic films 32 of the sub tanks 30 determined by the elastic deformation amount determination unit 330 is equal to or greater than a prescribed threshold value which corresponds to the minimum ink position, in other words, if the amount of ink inside the sub tanks 30 is equal to or greater than the allowable minimum amount, then the return position RP is taken as the home position for the carriage 20 in the main scanning direction M, and the carriage 20 performs a reciprocal movement by returning at the return position RP, rather than moving until it reaches the original home position P0. In other words, the carriage 20 performs a reciprocal operation following the main scanning direction M, to the left-hand side of the RP in FIG. 20. On the other hand, if the amount of deformation of the elastic films 32 of the sub tanks 30 determined by the amount of elastic deformation unit 330 exceeds a threshold value, in other words, if the amount of ink inside the sub tanks 30 is less than an allowable minimum amount, then the carriage 20 is moved successively to the head closing position P1, the ink supply coupling position P2, the deformation recovery start position P3, and the deformation recovery end position P4, and the carriage 20 waits until elastic recovery of the elastic films 32 has been completed due to the elastic force of the elastic films 32 and the action of the arm abutting members 66.

In reference to FIG. 23, the positional relationship between the members on the main body (the arm abutting members 66, the valve abutting members 67 and the ink supply coupling sections 74), which are fixed to the main body of the inkjet recording apparatus 1100 and do not move with the movement of the carriage 20, and the carriage 20 which moves relatively with respect to the members on the main body, is described below.

FIG. 23 shows a state where the carriage 20 has been moved in the main scanning direction through a distance of "L0" further in the leftward direction (a direction away from the liquid ejection region) from the original home position P0 shown in FIG. 20, and a position (valve abutment position) where the valve abutting member 67 has abutted against the end sections 42*c* of the head opening and closing valves 42 is shown. Taking this valve abutment position to be the reference "0", L1 indicates the distance until the head opening and closing valves 42 assume a closed state, L2 indicates the distance until the sub tank opening and closing valves 46 assume an open state, and L3 indicates the distance until the elastic films 32 of the sub tanks 30 start to recover from deformation. The relationships between L0, L1, L2 and L3 in FIG. 23 and P0, P1, P2, P3 and P4 in FIG. 20 are as follows: $L0<|P0-P1|$; $L1=|P0-P1|-L0$; $L2=|P2-P1|-L1$; and $L3=|P3-P2|-L2$. Furthermore, L1, L2 and L3 satisfy the relationship stated in Formula 1 below.

$$L3 \geqq L2 \geqq L1 \quad \text{(Formula 1)}$$

Furthermore, a spare margin is allowed in the movable stroke of the head opening and closing valves 42 and the sub tank opening and closing valves 46, according to the movement distance of the carriage 20, $|P4-P3|$, from the start of deformation recovery of the elastic films 32 of the sub tanks 30 until the end of deformation recovery.

The sudden pressure change which occurs when the head liquid supply flow channel 41 is closed by the head opening and closing valve 42 is absorbed by the movement of the elastic film 32 of the corresponding sub tank 30, thereby preventing the occurrence of ink leaks from the nozzles (101 in FIG. 7) of the head 100. Furthermore, by means of the spare margin in the movable stroke of the head opening and closing valves 42 and the sub tank opening and closing valves 46, it is possible, in accordance with the movement of the carriage 20, to achieve control whereby the head opening and closing valves 42 are closed, the sub tank opening and closing valves 46 are opened, and the elastic films 32 are made to recover from deformation, in sequence, each elastic film 32 being caused to revert to its initial state (for example, a maximum ink position), by means of the action of the corresponding arm 64. The closing of the head opening and closing valves 42 and the opening of the sub tank opening and closing valves 46 may be performed simultaneously. Furthermore, the opening of the sub tank opening and closing valves 46 and the start of the deformation recovery of the elastic films 32 may also be simultaneous.

Figure 24:
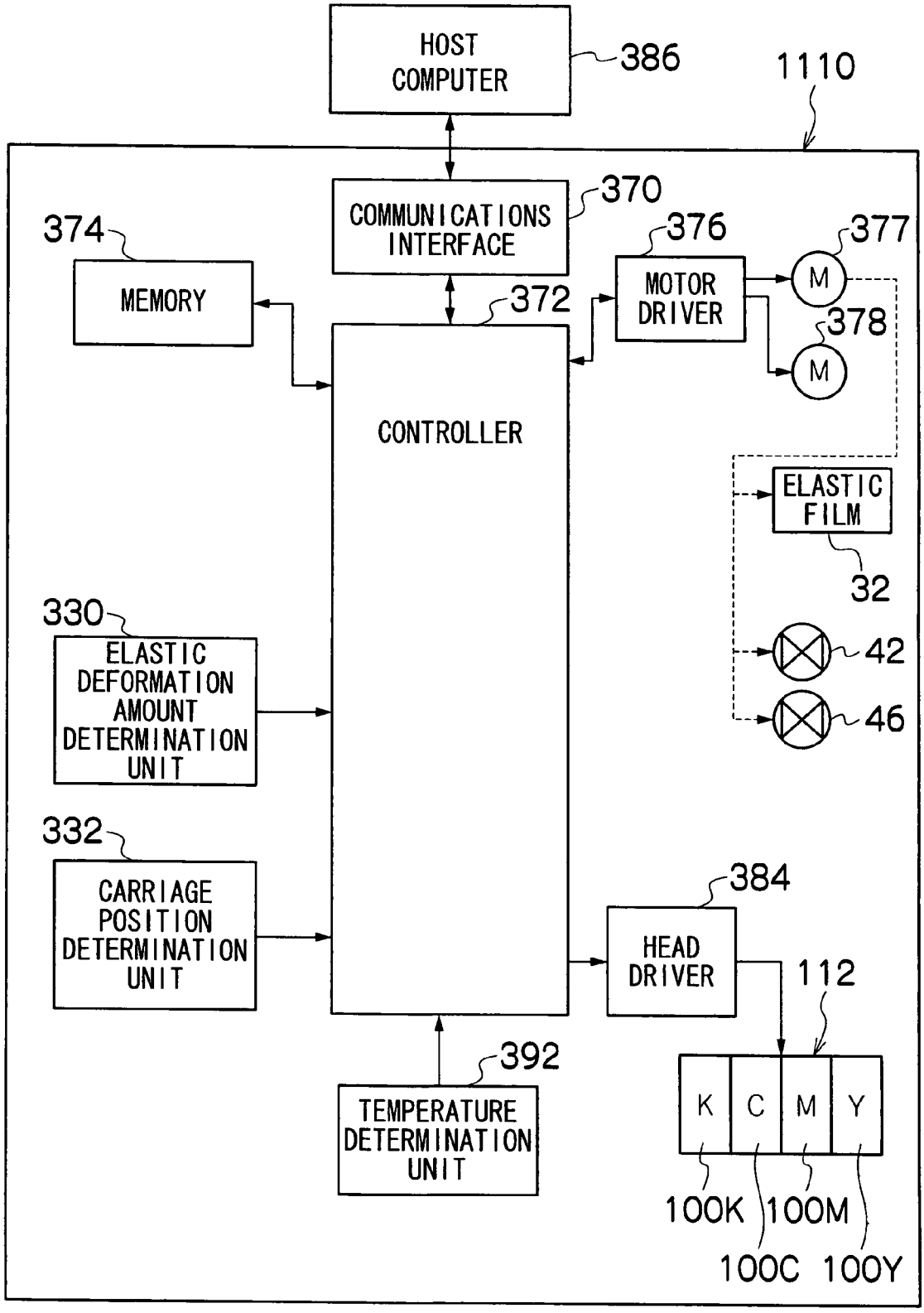
FIG. 24 is a block diagram of the inkjet recording apparatus relating to the second embodiment.

FIG. 24 is a block diagram showing the composition of the control system of the inkjet recording apparatus 1100 according to the second embodiment. Constituent elements which are the same as those of the first embodiment shown in FIG. 13 are labeled with the same reference numerals and details which have been described already in relation to the first embodiment are not described further here.

In the present embodiment, the linear movement motor 60 provided in the first embodiment shown in FIG. 13 is omitted. Furthermore, a movement operation of the carriage 20 caused by the carriage conveyance motor 377 is used in order to perform the actions of moving the elastic films 32, opening and closing the head opening and closing valves 42, and opening and closing the sub tank opening and closing valves 46.

The carriage position determination unit 332 determines the position of the carriage 20 at least between the return position RP and the deformation recovery end position P4 shown in FIG. 20. More specifically, if the carriage 20 is positioned in at least one of the return position RP, the original home position P0, the head closed position P1, the ink supply coupling position P2, the deformation recovery start position P3 and the deformation recovery end position P4, then a position determination signal indicating the position of the carriage 20 is output. It is also possible to output a position determination signal for each bar on the linear encoder 202 shown in FIG. 20.

The controller 372 specifies the movement destination of the carriage 20 and the movement speed of the carriage 20, to the motor driver 376, on the basis of the position of the carriage 20 as determined by the carriage position determination unit 332.

An example has been described above in which the actions of moving the elastic films 32, opening and closing the head opening and closing valves 42, and opening and closing of the sub tank opening and closing valves 46 are carried out on the basis of amount of movement of the carriage 20 with reference to a particular home position (and more specifically, on the basis of the amount of movement of the carriage 20 as determined by the linear encoder 202 and the optical sensor 204 shown in FIG. 20), but the present invention is not limited to a case of this kind. It is also possible to perform the actions of moving the elastic films 32, opening and closing the head opening and closing valves 42, and opening and closing the sub tank opening and closing valves 46, on the basis of the amount of drive of the carriage conveyance motor 377 with reference to a particular home position.

Figure 25:
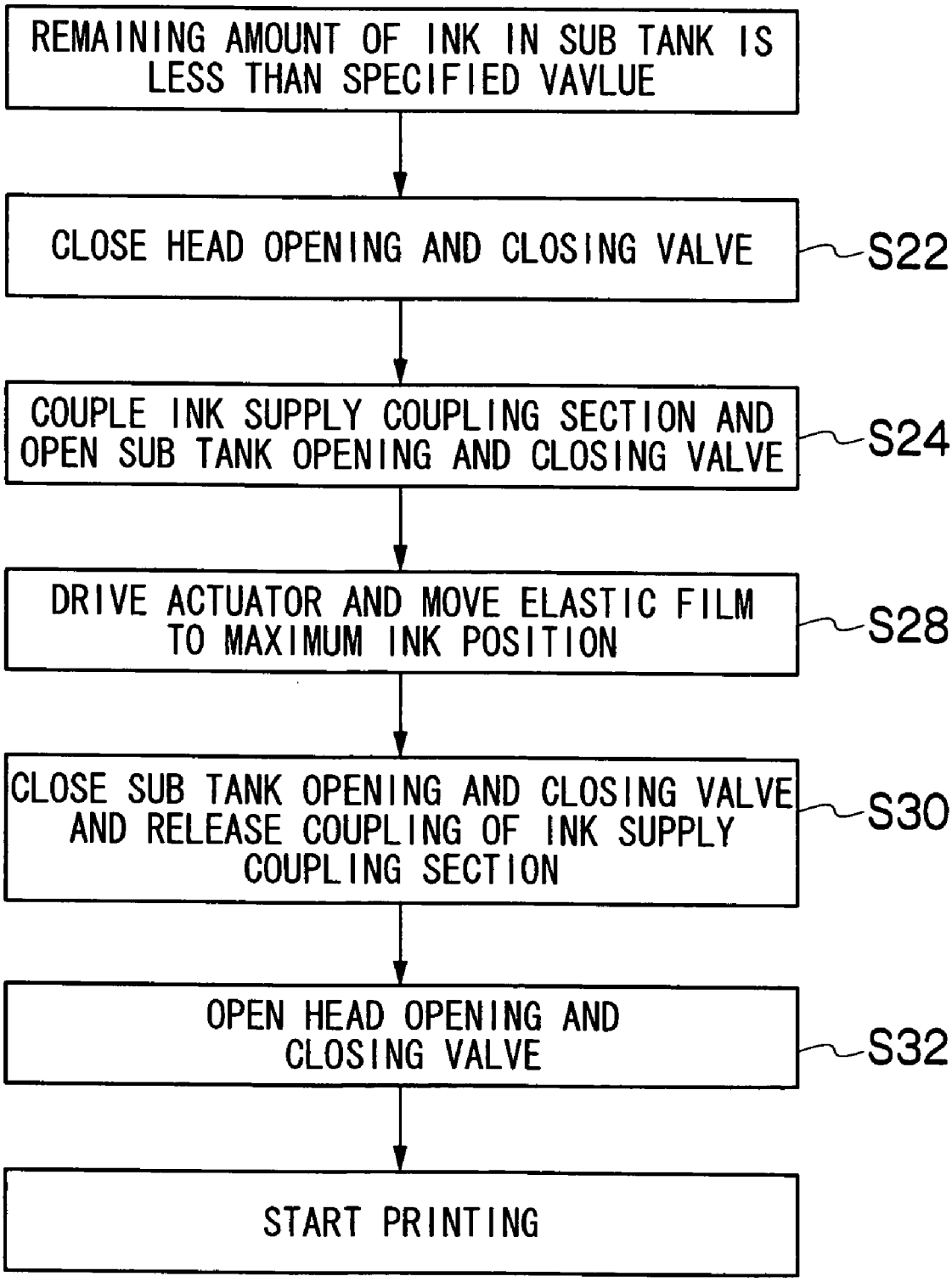
FIG. 25 is an outline flowchart showing the sequence of one example of a liquid supply process after initial filling according to the second embodiment.

FIG. 25 is a flowchart showing the sequence of one example of a liquid supply process after initial filling in the present embodiment. This liquid supply process is carried out under the control of the controller 372 in FIG. 24, in accordance with a program which is previously stored in the memory 374 shown in FIG. 24. Here, it is assumed that ink has already been initially filled from the main tank 70 to the sub tank 30, and furthermore, that ink has already been initially filled from the sub tank 30 to the head 100.

Immediately after initial filling, as shown in FIG. 18B, the sub tank 30 is in a state where it accommodates a maximum amount of ink, and the elastic film 32 is in a state where it has recovered from elastic deformation. In this case, in the elastic deformation amount determination unit 330 shown in FIG. 24, the maximum ink position is determined and a "maximum ink position signal" is output. In FIG. 18B, the arm abutting member 66 moves in the direction of the arrow RA relatively with respect to the engaging section 62*a* of the arm 64, thereby releasing the abutment between the arm butting member 66 and the arm 64. The elastic film 32 of the sub tank 30 is maintained at the maximum ink position, due to its elastic force. In FIG. 18B, in order to aid understanding of the present embodiment, a state where there is absolutely no elastic deformation of the elastic film 32 (a state where there is no bending of the elastic film 32) is depicted as the maximum ink position, but the invention is not limited in particular to a case of this kind, and a state where there is a little elastic deformation in the elastic film 32 (a state where there is a little bending of the elastic film 32) may also be taken as the maximum ink position.

Furthermore, immediately after initial filling of ink, the sub tank opening and closing valves 46 assume a closed state, the head opening and closing valves 42 assume an open state, and the coupling between the ink supply coupling sections 74 and the ink supply receiving coupling sections 44 is in a released state.

Thereupon, when ink is ejected from the head 100, the ink is supplied from the sub tanks 30 to the head 100, the amount of ink inside the sub tanks 30 becomes lower and elastic deformation occurs in the elastic films 32 of the sub tanks 30. The amount of elastic deformation gradually increases in accordance with the amount of ink supplied from the sub tanks 30 to the head 50.

The controller 372 judges whether or not the remaining amount of ink in the sub tank 30 in FIG. 17A is less than a specific amount by comparing the amount of elastic deformation determined by the elastic deformation amount determination unit 330 in FIG. 24 with a maximum allowable value stored previously in the memory 374 in FIG. 24 (a threshold value which corresponds to the minimum ink position). If the remaining amount of ink in the sub tank 30 has become less than the specified value, in other words, if the amount of elastic deformation of the elastic film 32 has become greater than the maximum tolerable value as shown in FIG. 18A, then the steps S22 to S34 in FIG. 25 are carried out.

Firstly, the carriage conveyance motor 377 is driven by the motor driver 376 in FIG. 24 so as to move the carriage 20 to the head closed position P1 via the original home position P0 shown in FIG. 20, thereby causing the valve abutting member 67 to abut against the end sections 42*c* of the head opening and closing valves 42 and thus closing the head opening and closing valves 42 (S22) as shown in FIG. 23. In other words, the head liquid supply flow channels 41 between the head 100 and the sub tanks 30 are closed.

Thereupon, the carriage conveyance motor 377 is driven by the motor driver 376 in FIG. 24 so as to move the carriage 20 to the ink supply coupling position P2 shown in FIG. 20 in such a manner that the ink supply coupling sections 74 couple with the ink supply receiving coupling sections 44 of the carriage 20, and furthermore the sub tank opening and closing valves 46 are opened (S24).

Thereupon, the carriage conveyance motor 377 is driven by the motor driver 376 in FIG. 24 so as to move the carriage 20 to the deformation recovery start position P3 shown in FIG. 20, and to then move the carriage 20 further from the deformation recovery start position P3 to the deformation recovery end position P4, thereby causing each of the elastic films 32 to move in the direction of arrow C via the arm 64, as shown in FIG. 18A, and thus assisting the elastic film 32 to recover from deformation (S28). In so doing, as shown in FIG. 18B, the amount of elastic deformation of the elastic film 32 becomes a minimum value, and the elastic deformation amount determination unit 330 shown in FIG. 24 outputs a maximum ink position signal.

Thereupon, the carriage conveyance motor 377 is driven by the motor driver 376 in FIG. 24 to move the carriage 20 between the ink supply coupling position P2 and the head closed position P1 shown in FIG. 20, thereby closing the sub tank opening and closing valves 46 (S30). In other words, the liquid flow channels between the main tanks 70 and the sub tanks 30 are closed. Here, the ink supply coupling sections 74 and the ink supply receiving coupling sections 44 are separated from each other. In other word, the coupling of the ink supply coupling sections 74 is released.

Thereupon, the carriage conveyance motor 377 is driven by the motor driver 376 in FIG. 24 to move the carriage 20 between the head closed position P1 shown and the original home position P0 in FIG. 20, thereby opening the head opening and closing valves 42 (S34). In other words, the head liquid supply flow channel 41 between the head 100 and the sub tank 30 is opened.

In so doing, the internal pressure of the sub tank 30 is set to a prescribed initial value (initial negative pressure), and printing can be started.

The initial negative pressure of the sub tank 30 may also be switched in accordance with the print mode, or the ambient temperature, or the ink temperature or the ink viscosity. More specifically, the deformation recovery end position P4 shown in FIG. 20 is switched in accordance with the print mode, the ambient temperature, the ink temperature or the ink viscosity. FIG. 15 shows an example of the initial negative pressure settings for the sub tank 30 in accordance with the print mode, and FIG. 16 shows an example of initial negative pressure settings for the sub tank 30 in accordance with the ambient temperature.

Figure 26:
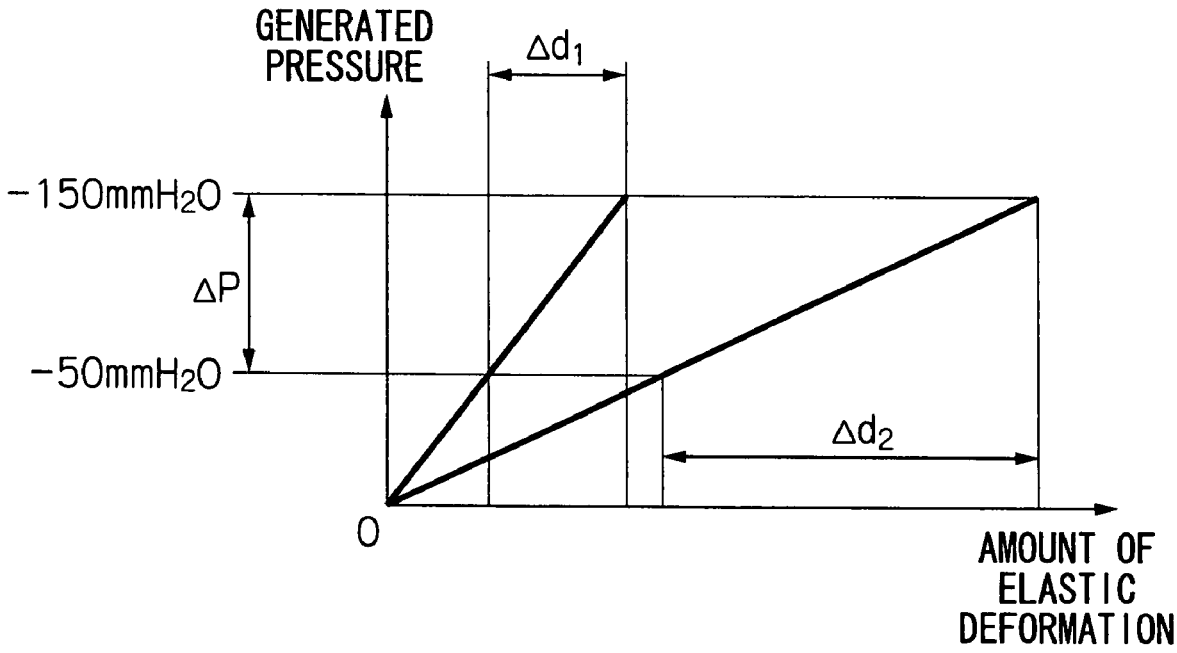
FIG. 26 is a diagram showing the relationship between the amount of elastic deformation of the elastic film of the sub tank, and the pressure generated in the sub tank due to the elastic deformation of the elastic film.

FIG. 26 is a diagram showing the relationship between the amount of elastic deformation of the elastic film 32 of the sub tank 30 and the pressure generated inside the sub tank 30. According to the present embodiment, by using an elastic film movement device (principally constituted by the linear movement motor 60 in the first embodiment, and principally constituted by the carriage conveyance motor 377, the carriage 20 and the arm abutting members 66 in the second embodiment), it is possible to reduce the amount of elastic deformation of the elastic film 32 in accordance with the change ΔP in the generated pressure. Supposing that the coefficient of elasticity of the elastic film of the sub tank is set to a high value in order to raise the speed of liquid supply to the sub tank, then there would be a large variation in the negative pressure in the sub tank as a result of reduction in the liquid volume in the sub tank as liquid is ejected from the head; however, according to embodiments of the present invention, it is possible to reduce the variation in the negative pressure in the sub tank that occurs as the liquid volume in the sub tank declines as liquid is ejected from the head. Therefore, it is possible to maintain the specified negative pressure for a long period of time. In other words, it is possible to eject liquid stably over a long period of time, by means of one "pit-stop" supply operation. The amount of elastic deformation, Δd2, of the elastic film 32 according to embodiments of the present invention which corresponds to the tolerable change ΔP in the generated pressure can be set to a value three or more times greater than the amount of elastic deformation Δd1 in a conventional composition where no elastic film movement device is provided and where the coefficient of elasticity of the elastic film is set to a high value.

In the first embodiment and the second embodiment, a bubble reservoir may be provided in the upper portion of the sub tank 30, and the air bubbles may be removed from the bubble reservoir before supplying ink from the main tank 70 to the sub tank 30. By supplying ink by forcibly causing the elastic film 32 of the sub tank 30 to recover from deformation, after removing any compressible gas, it is possible to supply ink at even greater speed.

Embodiments of the present invention have been described in detail above, but the present invention is not limited to the embodiments described above, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a head which ejects liquid;

a carriage which conveys the head;

a sub tank which is mounted on the carriage, accommodates the liquid to be supplied to the head, and has an elastic film deforming elastically in accordance with supply of the liquid to the head;

a liquid flow channel opening and closing valve which opens and closes a first liquid flow channel between the head and the sub tank;

a main tank which stores the liquid to be supplied to the sub tank;

a liquid supply coupling section which couples a second liquid flow channel connected to the main tank, to the sub tank, in a state where the carriage is located in a predetermined home position; and an elastic film movement device which includes an actuator that moves the elastic film of the sub tank, the elastic film movement device driving the actuator to move the elastic film in a direction which causes the elastic film to recover from elastic deformation to assist deformation recovery of the elastic film, in a state where the first liquid flow channel is closed by means of the liquid flow channel opening and closing valve and the second liquid flow channel is coupled to the sub tank by means of the liquid supply coupling section.

2. The liquid ejection apparatus as defined in claim 1, wherein the elastic film movement device sets a pressure in the sub tank according to at least one of ambient temperature, temperature of the liquid, viscosity of the liquid, and an operation mode selected from a plurality of modes having respectively different consumption rates of the liquid.

3. The liquid ejection apparatus as defined in claim 1, wherein:

the liquid flow channel opening and closing valve opens and closes the first liquid flow channel between the head and the sub tank by using a movement operation of the carriage; and the elastic film movement device moves the elastic film to assist the deformation recovery of the elastic film by using the movement operation of the carriage.

4. The liquid ejection apparatus as defined in claim 1, further comprising a deformation amount determination device which determines an amount of deformation of the elastic film of the sub tank, wherein the elastic film movement device moves the elastic film of the sub tank according to the amount of deformation of the elastic film determined by the deformation amount determination device.

5. The liquid ejection apparatus as defined in claim 1, further comprising a home position determination device which determines whether the carriage is situated in a particular home position to output a determination signal, wherein the elastic film movement device moves the elastic film of the sub tank according to the determination signal outputted from the home position determination device, and an amount of movement of the carriage with reference to the home position or an amount of rotation of a motor which drives the carriage.

6. The liquid ejection apparatus as defined in claim 1, wherein:

a coupling home position where the carriage is withdrawn from a liquid ejection region and the second liquid flow channel is coupled with the sub tank by means of the liquid supply coupling section, and a return home position which is nearer to the liquid ejection region than the coupling home position, are provided for the carriage; and when an amount of the liquid in the sub tank is smaller than a prescribed minimum value, then the carriage is moved to the coupling home position and waits for the elastic film to be recovered from elastic deformation by means of the elastic film movement device, whereas when the amount of the liquid in the sub tank is equal to or greater than the prescribed minimum value, then the carriage returns to the return home position to perform a reciprocal movement.

7. A liquid supply method for a liquid ejection apparatus having a head which ejects liquid, a carriage which conveys the head, a sub tank which is mounted on the carriage and accommodates the liquid to be supplied to the head and which has an elastic film deforming elastically in accordance with supply of the liquid to the head, and a main tank which stores the liquid to be supplied to the sub tank, the liquid supply method comprising the steps of:

closing a valve provided in a first liquid flow channel between the head and the sub tank;

coupling a second liquid flow channel connected to the main tank, to the sub tank, in a state where the carriage is located in a predetermined home position;

driving an actuator to move the elastic film in a direction which causes the elastic film to recover from elastic deformation to assist deformation recovery of the elastic film of the sub tank, in a state where the valve provided in the first liquid flow channel is closed and the second liquid flow channel is coupled to the sub tank;

separating the second liquid flow channel connected to the main tank, from the sub tank; and opening the valve provided in the first liquid flow channel between the head and the sub tank.

* * * * *